US011623446B2

(12) United States Patent
Fukunaga et al.

(10) Patent No.: US 11,623,446 B2
(45) Date of Patent: Apr. 11, 2023

(54) INK SUPPLY DEVICE AND IMAGE FORMING SYSTEM

(71) Applicant: KYOCERA Document Solutions Inc., Osaka (JP)

(72) Inventors: Yasuyuki Fukunaga, Osaka (JP); Yuzo Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 83 days.

(21) Appl. No.: 17/355,311

(22) Filed: Jun. 23, 2021

(65) Prior Publication Data

US 2021/0402778 A1 Dec. 30, 2021

(30) Foreign Application Priority Data

Jun. 24, 2020 (JP) ..... JP2020-108640

(51) Int. Cl.
*B41J 2/17* (2006.01)
*B41J 2/175* (2006.01)

(52) U.S. Cl.
CPC ..... *B41J 2/1707* (2013.01); *B41J 2/1752* (2013.01)

(58) Field of Classification Search
CPC ..... B41J 2/1707; B41J 2/1752; B41J 2/175; B41J 2/195; B41J 29/13; B41J 29/02
USPC ..... 347/1
See application file for complete search history.

(56) References Cited

U.S. PATENT DOCUMENTS

2006/0176347 A1* 8/2006 Hong ..... B41J 2/17593 347/85
2009/0244172 A1* 10/2009 Snyder ..... B41J 2/17596 347/88
2018/0162136 A1* 6/2018 Rietbergen ..... B41J 2/1752

FOREIGN PATENT DOCUMENTS

JP 2006-110834 A 4/2006

* cited by examiner

*Primary Examiner* — Matthew Luu
*Assistant Examiner* — Alexander D Shenderov
(74) *Attorney, Agent, or Firm* — Studebaker & Brackett PC

(57) ABSTRACT

An ink supply device includes a plurality of ink containers, a plurality of heater units, a frame, a lower fixing member and an upper fixing member. In the ink container, ink is stored. The heater units are arranged in a horizontal arrangement direction. The heater unit includes a tube in which the ink fed from the ink container is passed, a hearer heating the ink passing through the tube and a casing by which the tube and the heater are supported. In the frame, the ink containers and the heater units are stored. The lower fixing member is fixedly mounted to the frame and holds all lower portions of the heater units. The upper fixing member is detachably mounted to the frame and holds all upper portions of the heater units.

14 Claims, 19 Drawing Sheets

INK SUPPLY DEVICE AND IMAGE FORMING SYSTEM

INCORPORATION BY REFERENCE

This application is based on and claims the benefit of priority from Japanese patent application No. 2020-108640 filed on Jun. 24, 2020, which is incorporated by reference in its entirety.

BACKGROUND

The present disclosure relates to an ink supply device which supplies ink to an inkjet recording apparatus and an image forming system including the ink supply device.

An inkjet recording apparatus is provided with an ink container storing the ink supplied to an inkjet head. An ink supply device including the large-capacity ink container is provided on the assumption that a large amount of the ink is consumed.

To achieve good image quality, it is necessary to keep a viscosity of the ink within an appropriate range, but the viscosity of the ink may increase due to a low room temperature. Therefore, the ink supply device includes a means for heating the ink. As an example of the means for heating the ink, a heater unit including a tube and a heater is known. One end portion of the tube is connected to the large-capacity ink container, the other end portion of the tube is connected to an ink supply path of the inkjet recording apparatus, and the ink fed from the ink container is heated by a heater and supplied to the inkjet recording apparatus.

By the way, in the case of the inkjet recording apparatus which performs color printing using the inks of a plurality of colors, the ink supply device is provided with the ink container and the heater unit for each color. In order to compact a space occupied by the heater units, it is advantageous to house the tube and the heater in a plate-like housing and to stack a plurality of the housings. In this case, in consideration of easy maintenance, it is advantageous to stack the housings side by side in the horizontal direction as shown in FIG. 17, rather than to stack them in the vertical direction.

In this example, the innermost heater unit of the four heater units is fixedly attached to a frame using screws, and the adjacent heater units are connected to each other using screws. If the heater unit is failed, the failed heater unit must be detached for repairment or replacement. However, in this example, because the heater units are connected to each other using the screws, in order to detach the innermost heater unit, or the second or third heater unit from the innermost, all the heater units disposed on the front side of the heater unit to be detached must also be detached. Further, because the tube connected to the heater unit also needs to be detached, there is a possibility that troubles such as ink leakage and contamination increase. Therefore, it is desirable to have a configuration in which the failed heater unit can be detached without detaching the heater unit which is not failed.

To solve this problem, for example, a configuration in which the heater unit can be attached and detached to the frame by a latch lever is conceivable, but in a large device such as the ink supply device, because it is necessary to increase a rigidity of the latch lever and the housing, the cost may increase.

SUMMARY

In accordance with an aspect of the present disclosure, an ink supply device includes a plurality of ink containers, a plurality of heater units, a frame, a lower fixing member and an upper fixing member. In the ink container, ink is stored. The heater units are arranged in a horizontal arrangement direction. The heater unit includes a tube in which the ink fed from the ink container is passed, a hearer heating the ink passing through the tube and a casing by which the tube and the heater are supported. In the frame, the ink containers and the heater units are stored. The lower fixing member is fixedly mounted to the frame and holds all lower portions of the heater units. The upper fixing member is detachably mounted to the frame and holds all upper portions of the heater units.

In accordance with an aspect of the present disclosure, an image forming system includes the ink supply device and an inkjet recording apparatus including a conveyance unit conveying a sheet-like recording medium and an inkjet head ejecting the ink supplied through the tube on the recording medium conveyed by the conveyance unit.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the attached drawings, an image forming system 3 according to one embodiment of the present disclosure will be described.

Figure 1:
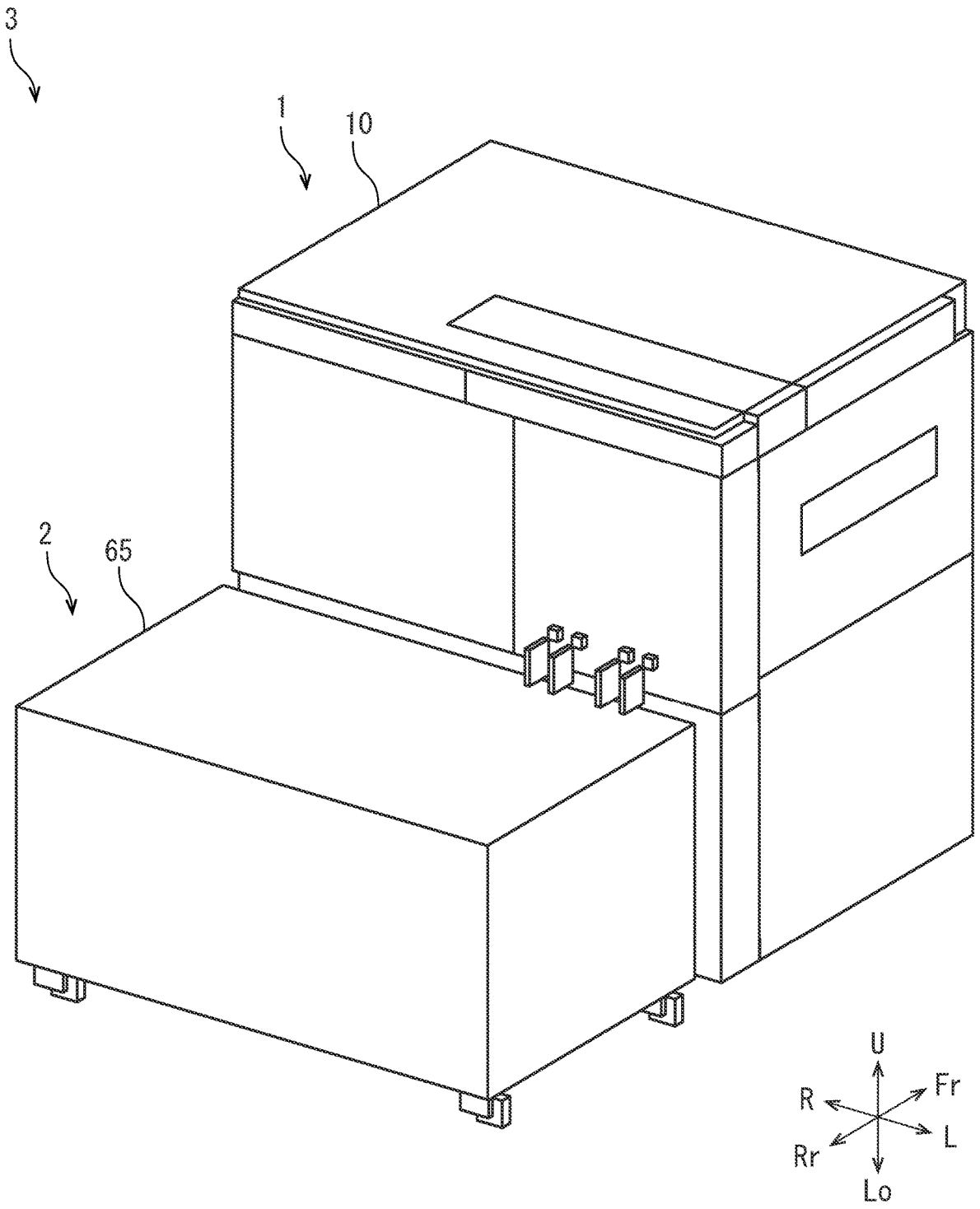
FIG. 1 is a perspective view showing an appearance of an ink supply device and a printer according to one embodiment of the present disclosure.
Figure 2:
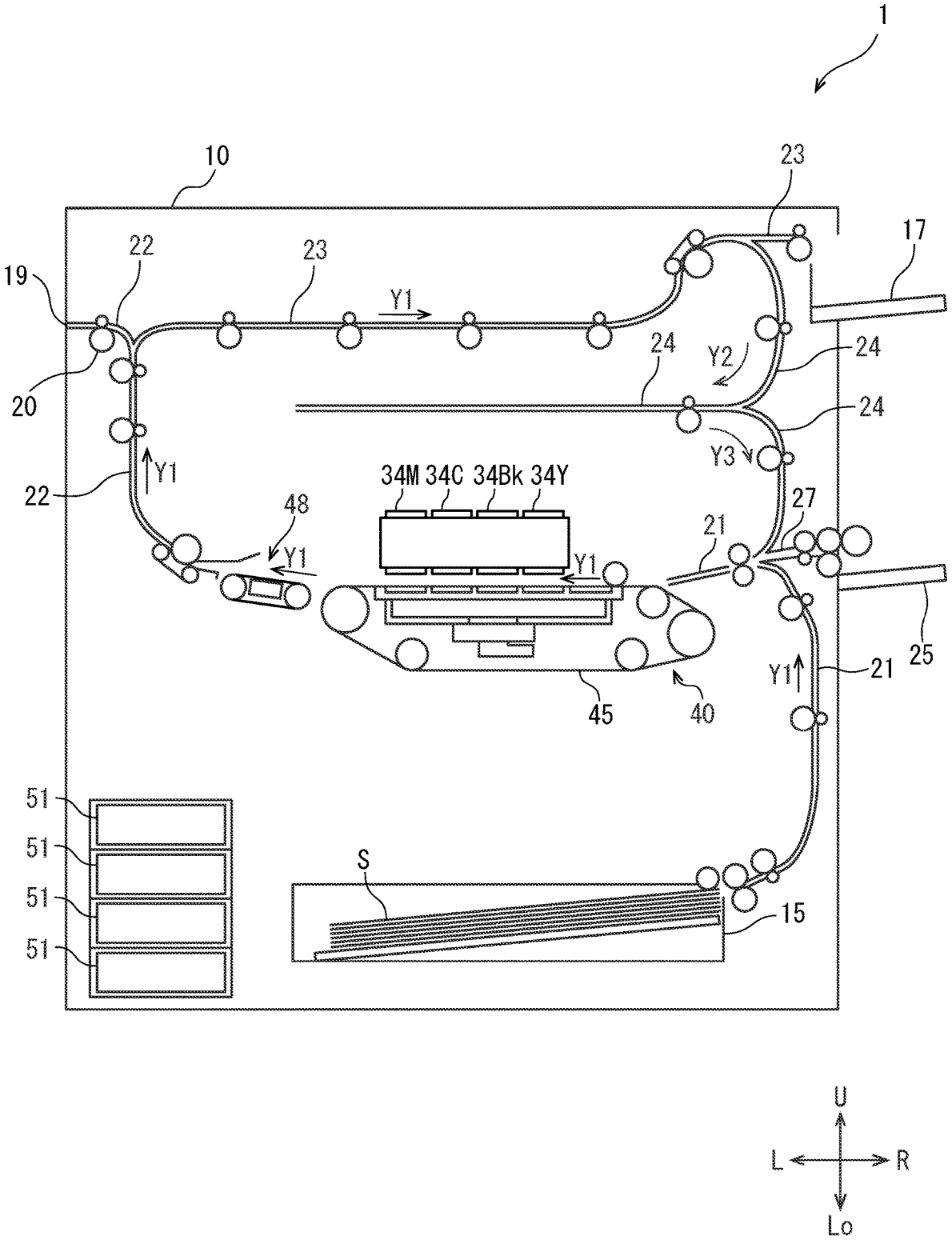
FIG. 2 is a front view schematically showing an inner structure of the printer according to the embodiment of the present disclosure.
Figure 3:
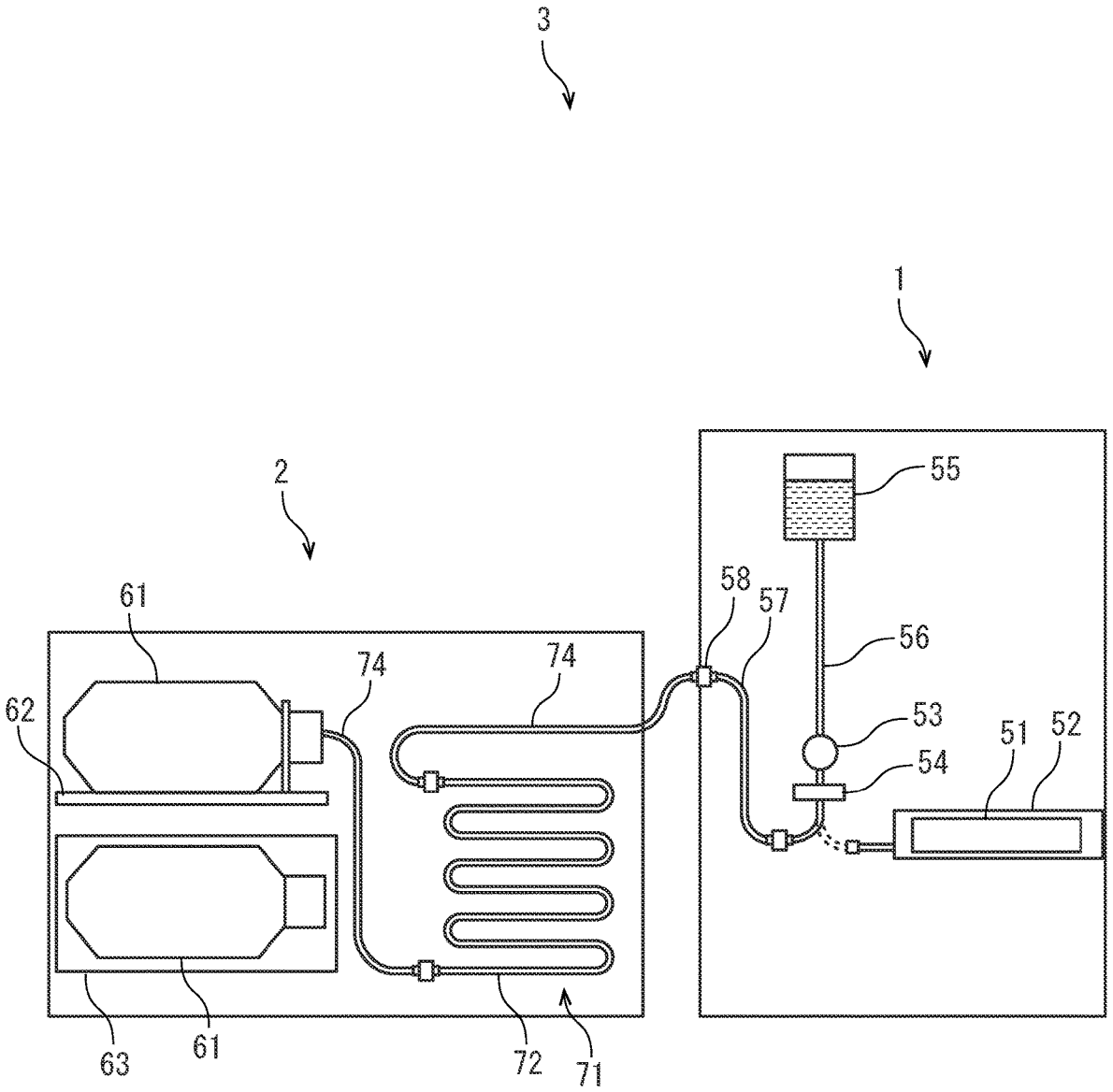
FIG. 3 is a front view schematically showing a path for supplying ink according to one embodiment of the present disclosure.

First, an entire structure of the image forming system 3 will be described. The image forming system 3 includes an ink supply device 2 and a printer 1 (an example of an inkjet recording apparatus). FIG. 1 is a perspective view showing an appearance of the ink supply device 2 and the printer 1. FIG. 2 is a front view schematically showing an inner structure of the printer 1. FIG. 3 is a view schematically showing an ink supply path. Hereinafter, a front side (Fr) in FIG. 1 (a front side of a paper plane on which FIG. 2 is drawn) is defined as a front side of the ink supply device 2 and the printer 1, and a left-and-right direction is described with reference to a direction in which the ink supply device 2 and the printer 1 are viewed from the front side. U, Lo, L, R, Fr and Rr marked in each figure show an upper, a lower, a left, a right, a front and a rear, respectively.

The printer 1 is an inkjet type image forming apparatus which ejects ink on a sheet S (an example of a sheet-like recording medium), such as a plane paper and a coated paper, and forms an image. The ink supply device 2 is disposed on the rear side of the printer 1, and supplies the ink to the printer 1.

The printer 1 includes a box-shaped main housing 10 in which various devices are stored. In the lower portion of the main housing 10, a drawable sheet feeding cassette 15 in which the sheet S is stored is provided. On the right side face of the main housing 10, a manual bypass tray 25 on which the sheet S is manually placed is provided. Above the manual bypass tray 25, a discharge tray 17 on which the sheet S with the image is stacked is provided. On the upper portion of the left side face of the main housing 10, a discharge port 19 through which the sheet S is conveyed to a post-processing device (not shown) adjacently disposed on the left side of the printer is formed.

In the center portion of the inside of the main housing 10, head units 34Y, 34Bk, 34C and 34M (called a head unit) each having one or more inkjet heads ejecting the ink to the sheet S are provided, and eject the inks of yellow, black, cyan and magenta, respectively. Below the head units 34, a conveyance unit 40 which attracts the sheet S, on which the image is formed, to a conveyance belt 45 and conveys it is provided. On the left side of the conveyance unit 40, a drying unit 48 which dries the sheet S with the image while conveying it is provided. In the left lower portion of the inside of the main housing 10, ink containers 51 filled with the inks are stored.

On the right side of the conveyance unit 40, a first conveyance path 21 extending from the sheet feeding cassette 15 to the conveyance unit 40 and a manual bypass path 27 extending from the manual bypass tray 25 and joined to the first conveyance path 21 are provided. On the left side of the drying unit 48, a second conveyance path 22 extending from the drying unit 48 to the discharge port 19 is provided. Above the head units 34, a third conveyance path 23 branched from the second conveyance path 22 and extending to the discharge tray 17 and a fourth conveyance path 24 branched from the third conveyance path 23 and joined to the first conveyance path 21 are provided. At the branch points between the second conveyance path 22 and the third conveyance path 23, and between the third conveyance path 23 and the fourth conveyance path 24, guide members (not shown) for guiding the conveyance of the sheet S are provided.

Next, an outline of an image forming operation of the printer 1 will be described. When an image forming job is input to the printer 1, the sheet S is fed from the sheet feeding feed cassette 15 or the manual bypass tray 25 and conveyed along the first conveyance path 21 in a Y1 direction. The sheet S is attracted to the conveyance belt 45 of the conveyance unit 40 and conveyed. Then, the head unit 34 ejects the ink drops on the sheet S, and an image is thus formed on the sheet S. The drying unit 48 accelerates the drying the sheet S on which the image is formed. Then, the sheet S is conveyed along the second conveyance path 22 and the third conveyance path 23, and then discharged on the discharge tray 17.

[Ink Supply Path] Next, the ink supply path will be described. FIG. 3 shows a configuration corresponding to one color of the ink. However, since the inks of the four colors are used in this embodiment, four similar configurations are provided. The printer 1 includes a container attachment part 52, a pump 53, a filter 54, a sub-tank 55 and a pump (not shown). To the container attachment part 52, the ink container 51 is attached. The pump 53 pumps the ink from the ink container 51. The filter 54 filters the ink to be pumped to the pump 53. The sub-tank 55 stores the ink pumped from the pump 53. The pump feeds the ink stored in the sub-tank 55 to the head unit 34. The ink container 51, the filter 54, the pump 53 and the sub-tank 55 are connected to by a main tube 56. One end of a relay tube 57 is connected to a coupling 58 provided on the rear face of the main housing 10 of the printer 1. When the ink supply device 2 is used, the upstream end portion of the main tube 56 is connected to the other end portion of the relay tube 57 in place of the ink container 51.

Figure 4:
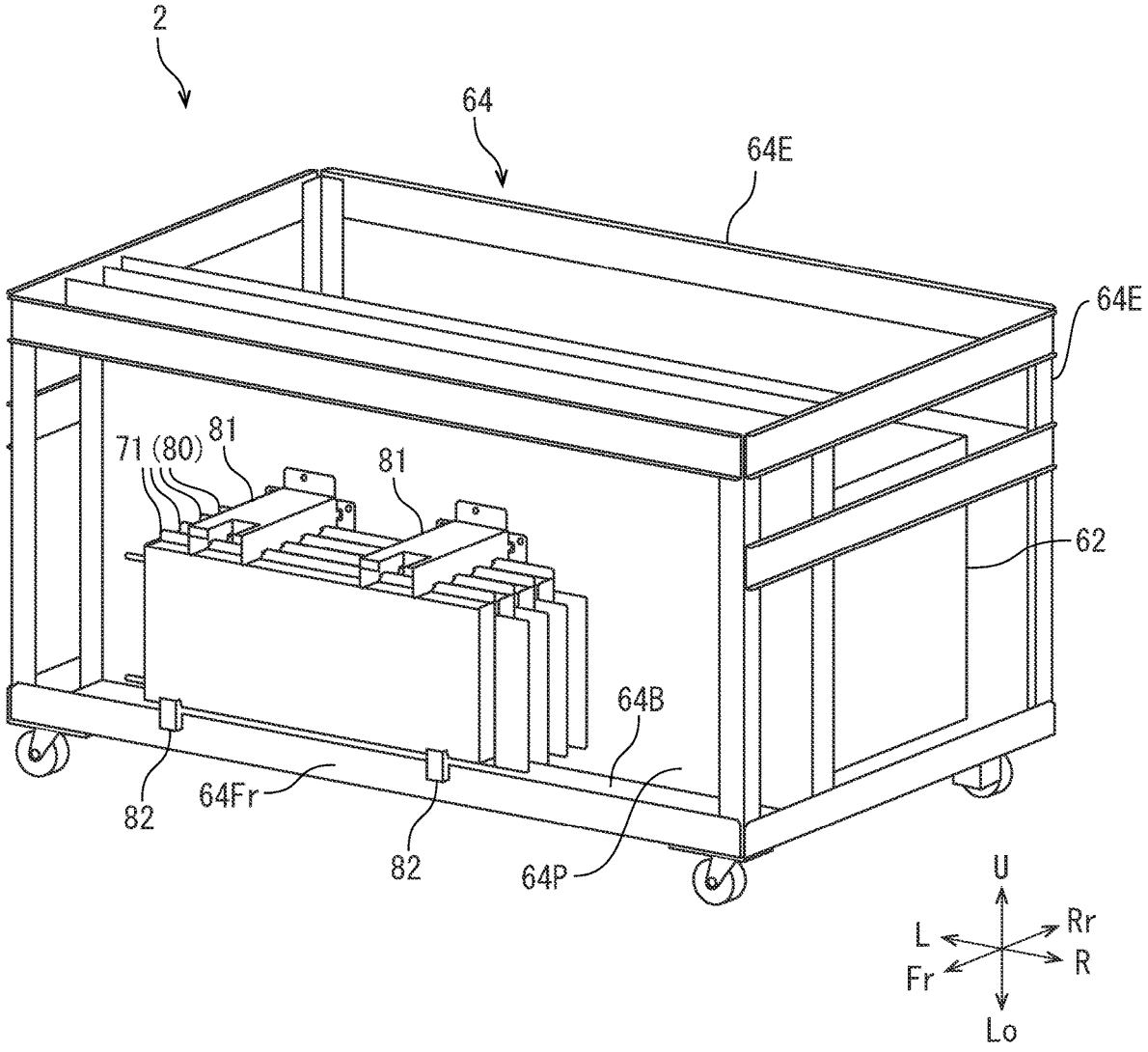
FIG. 4 is a perspective view showing an inside of the ink supply device according to the embodiment of the present disclosure.
Figure 5A:
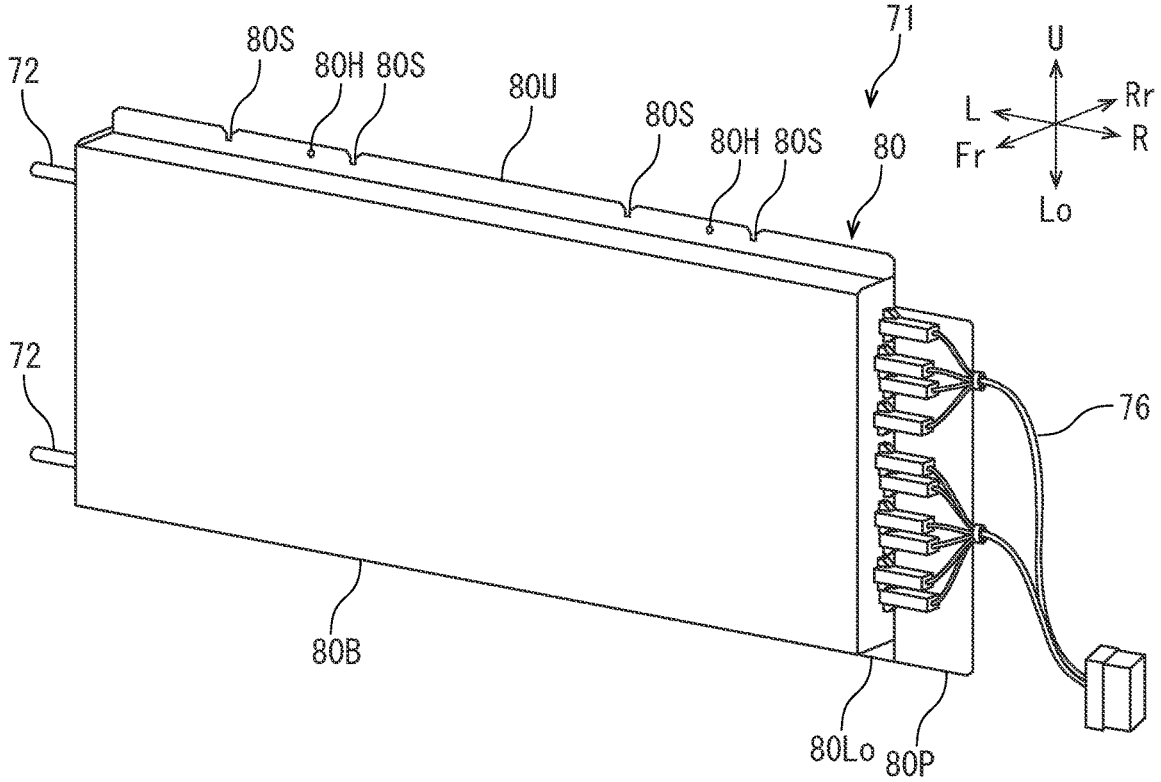
FIG. 5A is a perspective view showing a heater unit according to the embodiment of the present disclosure.
Figure 5B:
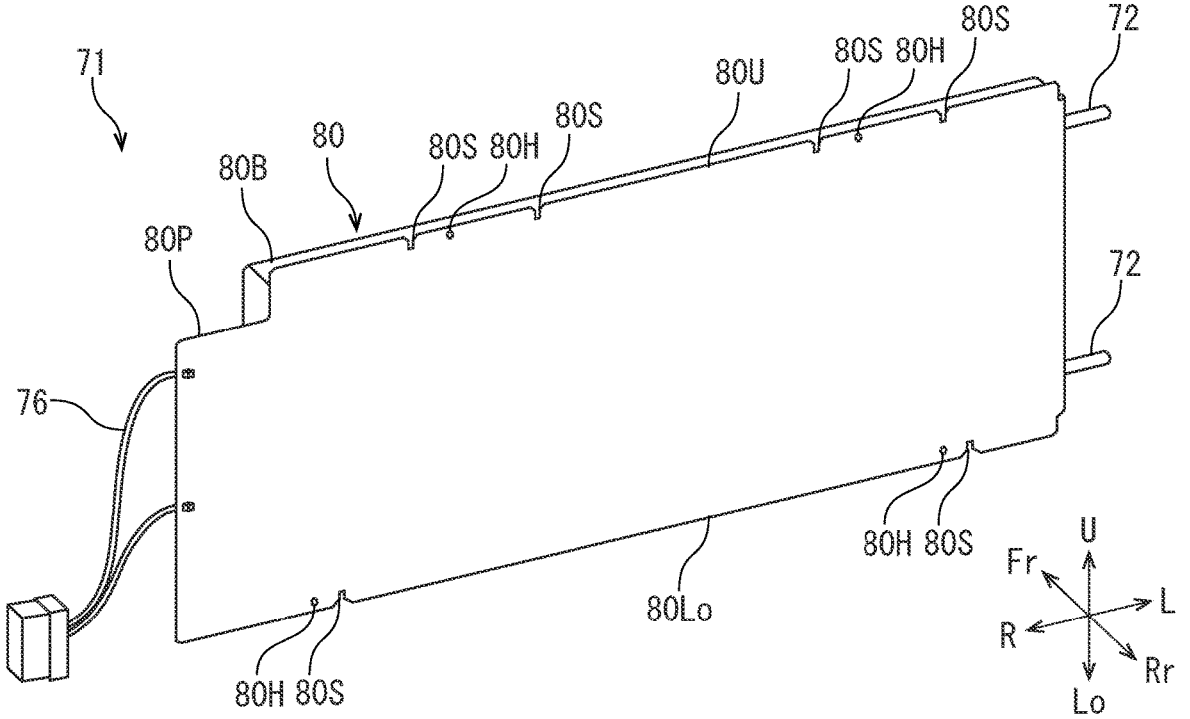
FIG. 5B is a perspective view showing the heater unit according to the embodiment of the present disclosure.
Figure 6:
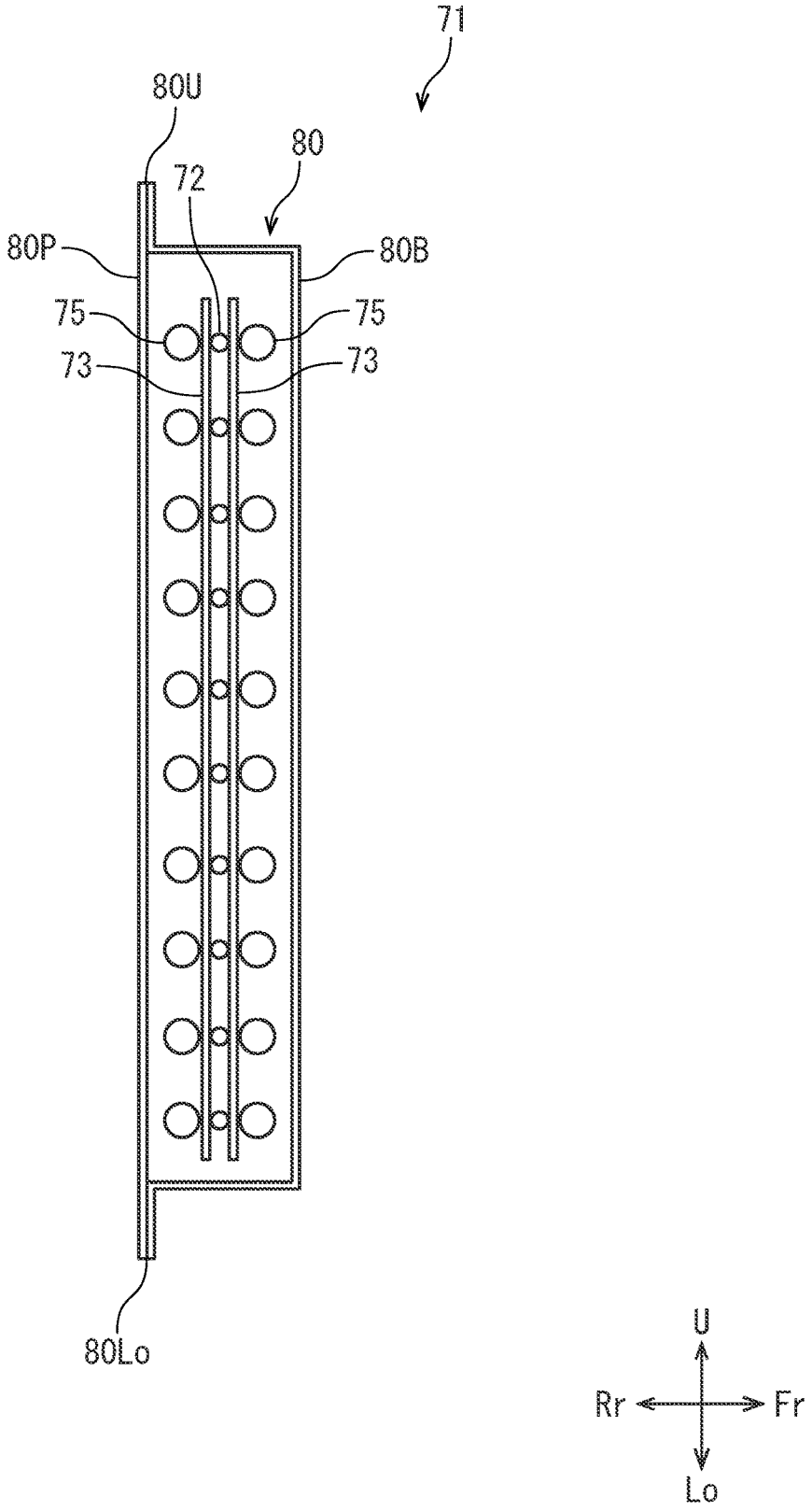
FIG. 6 is a sectional view schematically showing the heater unit according to the embodiment of the present disclosure.
Figure 7A:
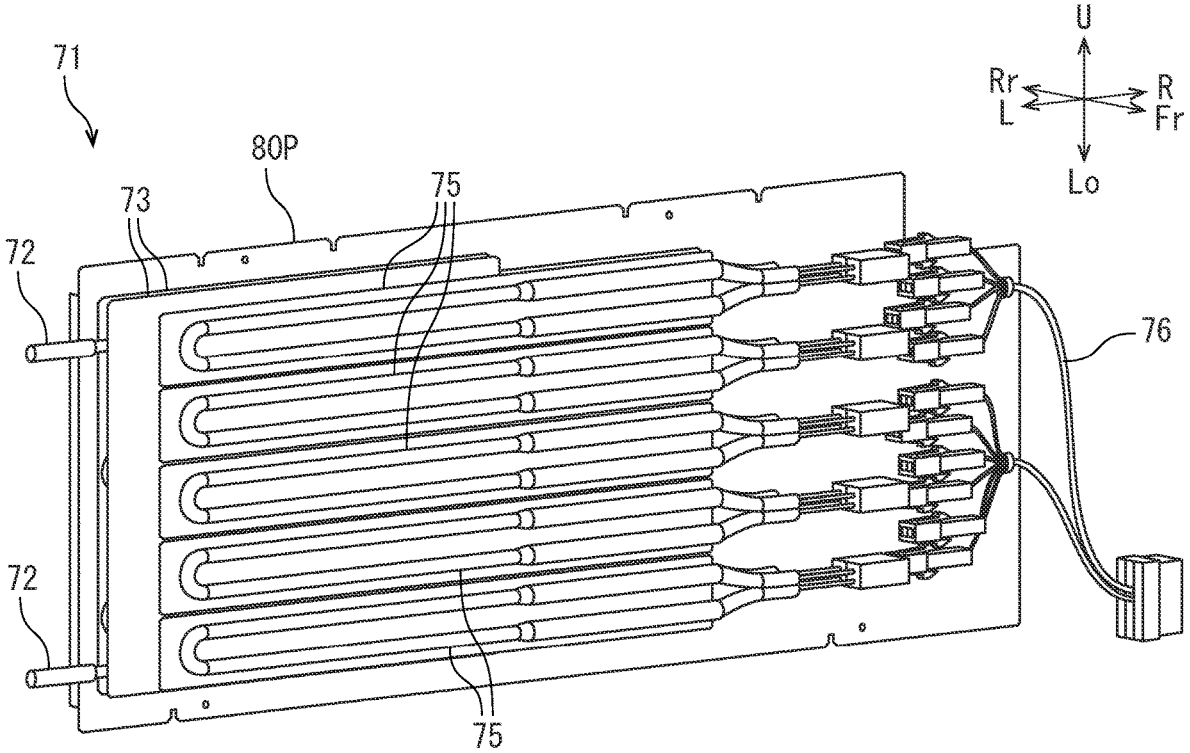
FIG. 7A is a perspective view showing a heater according to the embodiment of the present disclosure.
Figure 7B:
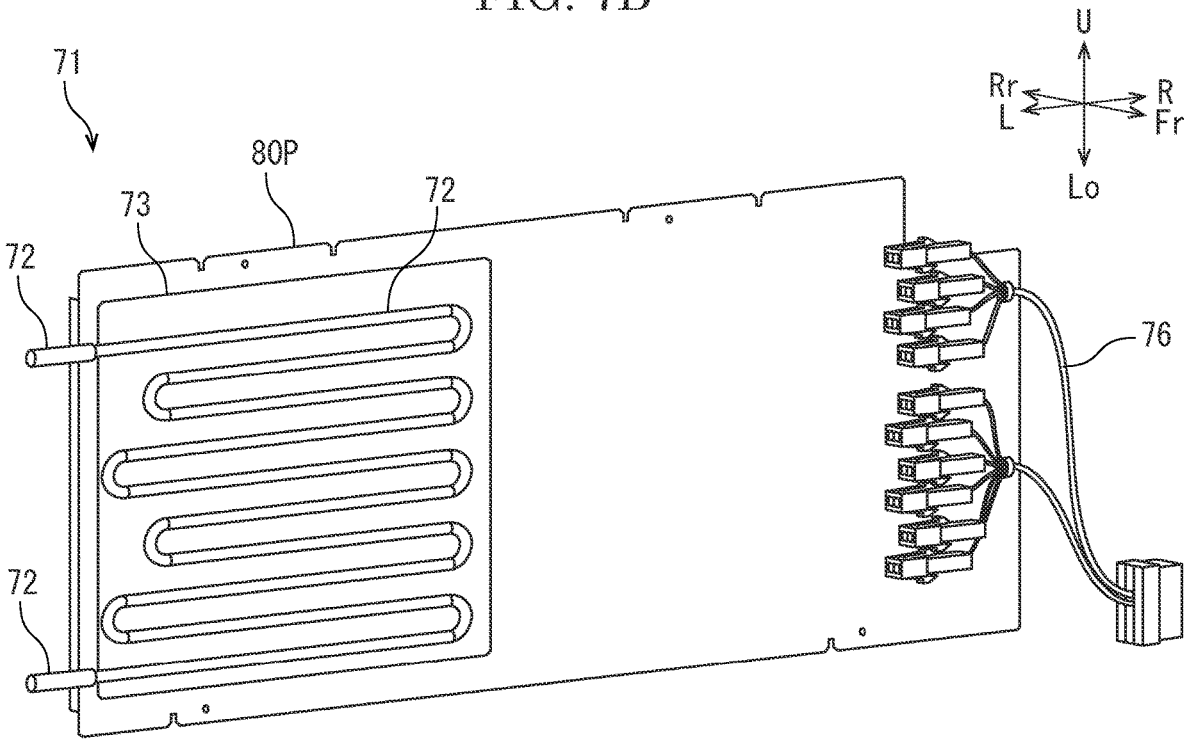
FIG. 7B is a perspective view showing a tube according to the embodiment of the present disclosure.
Figure 8:
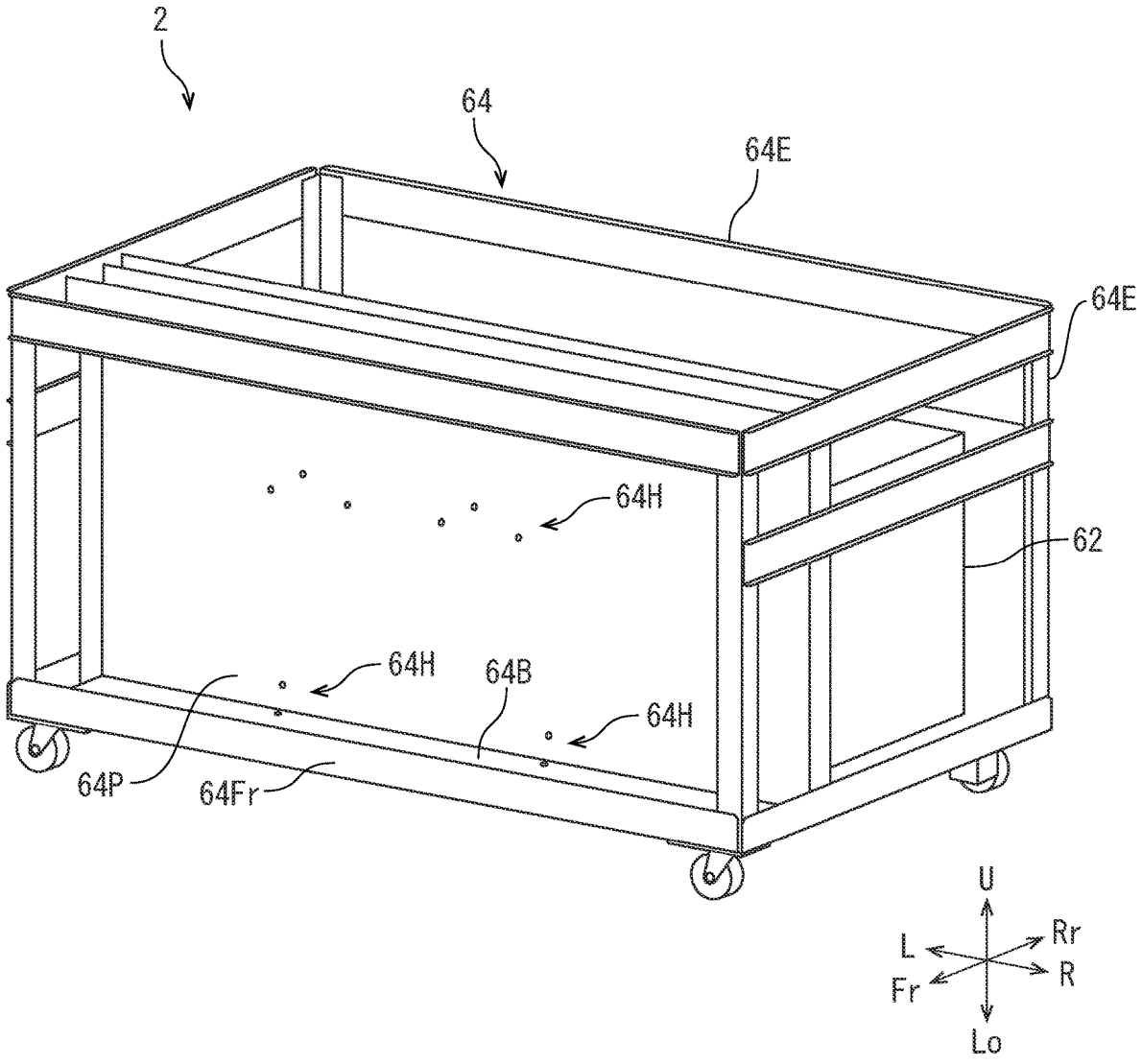
FIG. 8 is a perspective view showing a frame according to the embodiment of the present disclosure.
Figure 9A:
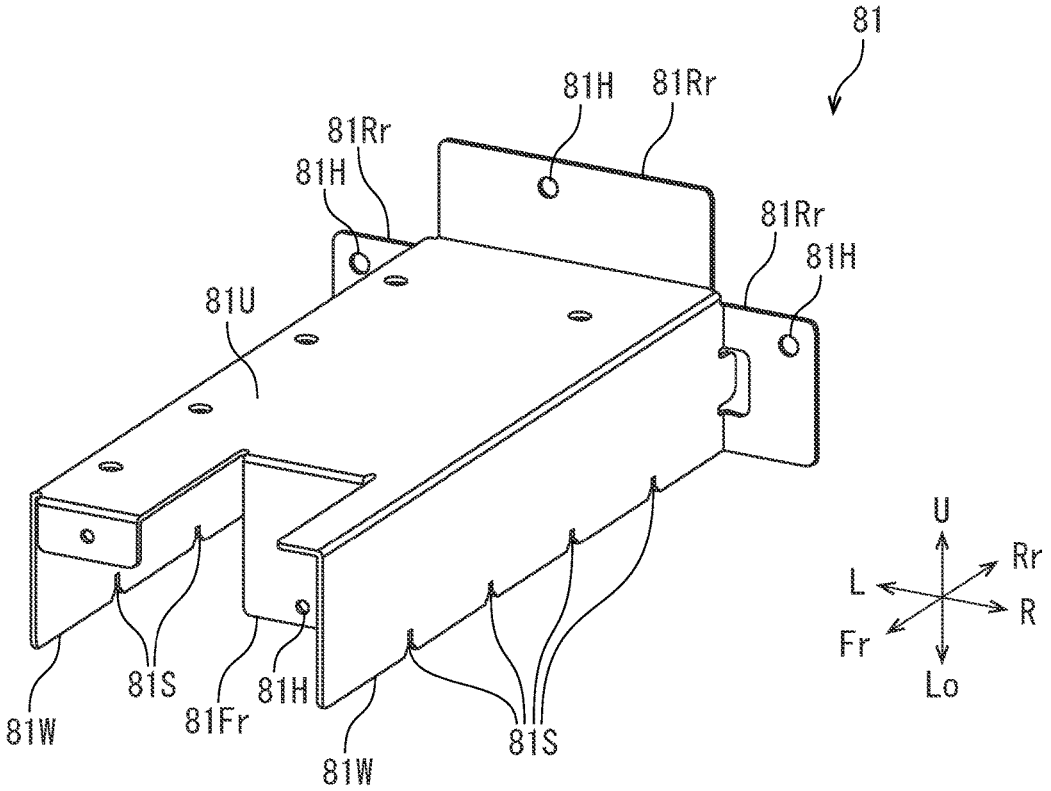
FIG. 9A is a perspective view showing an upper fixing member according to the embodiment of the present disclosure.
Figure 9B:
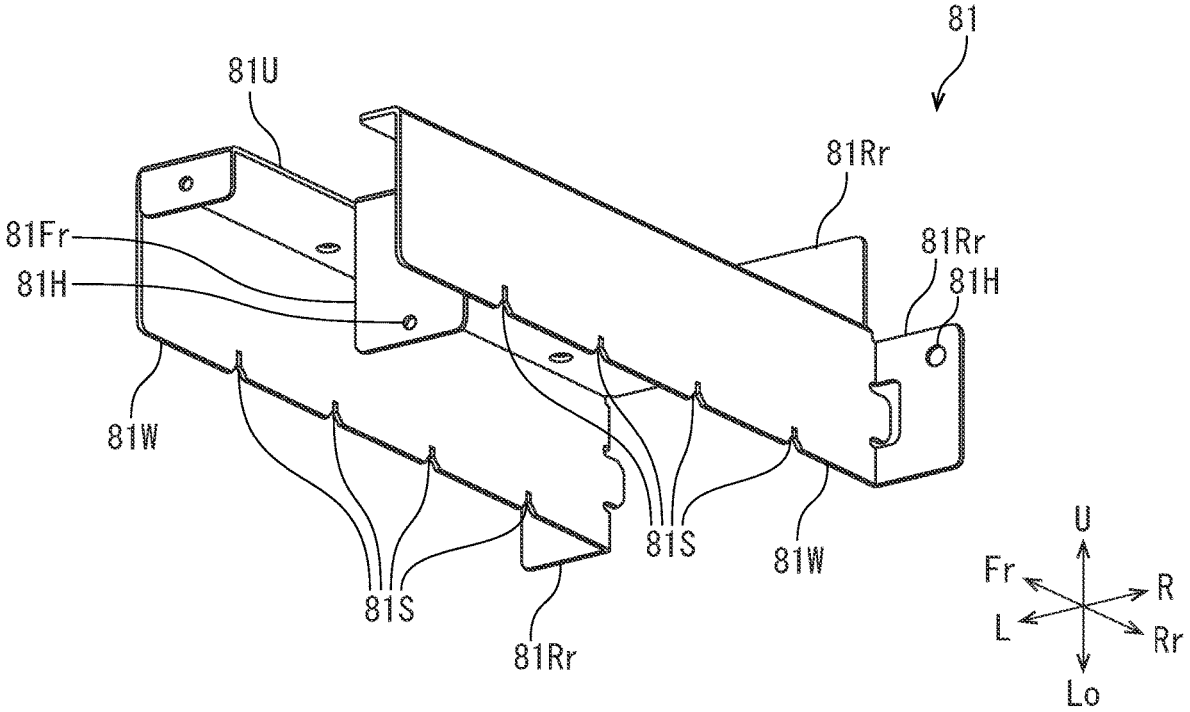
FIG. 9B is a perspective view showing the upper fixing member according to the embodiment of the present disclosure.
Figure 10A:
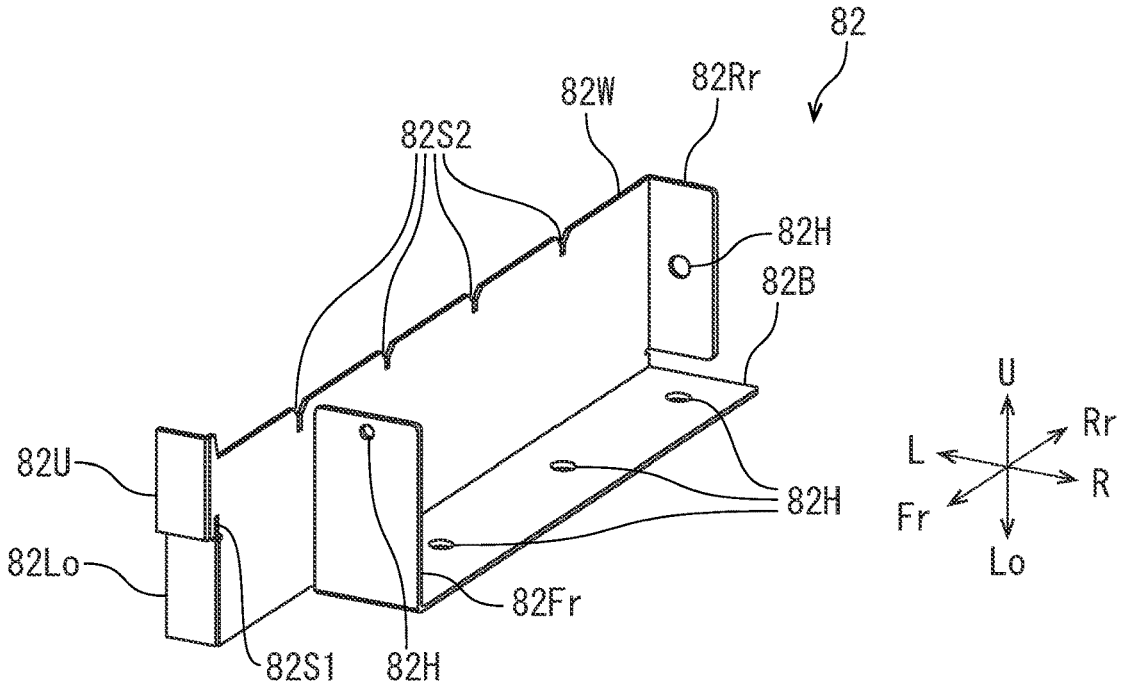
FIG. 10A is a perspective view showing a lower fixing member according to the embodiment of the present disclosure.

[Ink Supply Device] Next, the ink supply device 2 will be described. FIG. 4 is a perspective view showing an inside of the ink supply device 2. FIG. 5A and FIG. 5B are perspective views showing a heater unit 71. FIG. 6 is a sectional view schematically showing the heater unit 71. FIG. 7A is a perspective view showing a heater 75. FIG. 7B is a perspective view showing a tube 72. FIG. 8 is a perspective view showing a frame 64. FIG. 9A and FIG. 9B are perspective views showing an upper fixing member 81. FIG. 10A and FIG. 1B are perspective views showing a lower fixing member 82.

The ink supply device 2 includes a plurality of ink containers 61 storing the ink, a plurality of heater units 71 disposed side by side along a horizontal arrangement direction, a frame 64, a lower fixing member 82 and an upper fixing member 81. The heater unit 71 includes a tube 72 through which the ink fed from the ink container 61 passes, a heater 75 which heats the ink passing through the tube 72, and a plate-shaped casing 80 by which the tube 72 and the heater 75 are supported. The frame 64 stores the ink containers 61 and the heater units 71. The lower fixing member 82 is fixedly mounted to the frame 64 and holds the lower end portions of the heater units 71 collectively. The upper fixing member 81 is detachably mounted to the frame 64 and holds the upper end portions of the heater units 71 collectively.

[Ink Container] The ink supply device 2 (see FIG. 4) includes a container attachment part 62 to which the ink container 61 is attached. The ink container 61 has a capacity larger than the ink container 51 attached to the inside of the printer 1. Because the inks of the four colors are used in the present embodiment, the four ink containers 61 filled with the inks of yellow, black, cyan and magenta are provided. A reserve container storage part 63 in which the reserve ink container 61 is stored may be provided.

[Heater Unit] The heater unit 71 is provided for each ink container 61.

[Tube] The tube 72 (see FIG. 3 and FIG. 7) is a tube made of stainless steel, and has a regularly meandered shape. The tube 72 is held between two supporting plates 73 made of aluminum, for example, in the front-and-rear direction. One end portion of the tube 72 is connected to the ink container 61 through a relay tube 74. The other end portion of the tube 72 is connected to the coupling 58 of the printer 1 via the relay tube 74.

[Heater] The heater 75 (see FIG. 7A) is a cord heater formed by a heating wire covered with a silicon resin coating, for example. The heaters 75 are provided so as to be along the tube 72 on the front side and the rear side of the tube 72 via the supporting plates 73. To the heater 75, a power supply line 76 is connected.

[Casing] The casing 80 (see FIG. 5A to FIG. 6) stores the heaters 75 and the tube 72. The casing 80 is formed into a hollow plate-like shape having a size in the front-and-rear direction smaller than sizes in the left-and-right direction and in the upper-and-lower direction. The casing 80 includes a box-shaped member 80B and a plate-shaped member 80P. The box-shaped member 80B is formed into a box shape whose rear face is opened, and along the upper edge and the lower edge of the box-shaped member 80B, flange portions 80F protruding upward and downward are formed. The plate-shaped member 80P is a plate shaped member having almost the same sizes in the upper-and-lower direction and in the left-and-right direction as the box-shaped member 80B.

The flange portions 80F of the box-shaped member 80B are fixedly mounted to the upper end portion and the lower end portion of the plate-shaped member 80P using screws, for example. Hereinafter, a part containing the upper flange portion 80F of the box-shaped member 80B and the upper end portion of the plate-shaped member 80B is called an upper flange part 80U, and a part containing the lower flange portion 80F of the box-shaped member 80B and the lower end portion of the plate-shaped member 80P is called a lower flange part 80Lo. The upper flange part 80U has a notch 80S at four positions in the left-and-right direction. The lower flange part 80Lo has a notch 80S at two positions in the left-and-right direction. The upper flange part 80U has two screw holes 80H. One screw hole 80H is formed between the first notch 80S and the second notch 80S from the left, and the other screw hole 80H is formed between the third notch 80S and the fourth notch 80S from the left. The lower flange part 80U has two screw holes 80H. The screw hole 80H is formed on the right side of each notches 80S.

[Frame] The frame 64 (see FIG. 4 and FIG. 8) has ridge portions 64E forming ridges of a rectangular parallelepiped, a bottom plate portion 64B forming a bottom of the rectangular parallelepiped, and a partition wall portion 64P partitioning the inner space of the rectangular parallelepiped into the front space and the rear space. By mounting side plates and a top plate outside the frame 64, a housing 65 is formed. The four heater units 71 are disposed on the front side of the partition wall portion 64P, and the four ink containers 61 are disposed on the rear side of the partition wall portion 64P. The four heater units 71 are arranged side by side in a front-and-rear arrangement direction, and are fixedly attached to the frame 64 by the upper fixing member 81 and the lower fixing member 82, described later. The partition wall portion 64P and the bottom plate portion 64B have screw holes 64H for fixing the upper fixing member 81 and the lower fixing member 82 thereto. Along the front edge of the bottom plate portion 64B, an upward front wall portion 64Fr is formed.

[Upper Fixing Member] The upper fixing member 81 (See FIG. 9A and FIG. 9B) is formed by sheet metal working of a plate material made of stainless steel. The upper fixing member 81 has a top plate part 81U, wall parts 81W extending downward from both left and right end portions of the top plate part 81U, a rear fixing part 81Rr extending upward from the rear end portion of the top plate part 81U, rear fixing parts 81Rr extending leftward and rightward from the rear end portions of the left and right wall parts 81W, and a front fixing part 81Fr formed by cutting and raising downward a portion of the front end portion of the top plate part 81U. The rear fixing part 81Rr and the front fixing part 81Fr have screw holes 81H. Each wall part 81W has a notch 81S in the lower end portion at four positions in the front-and-rear direction at equal intervals.

Figure 10B:
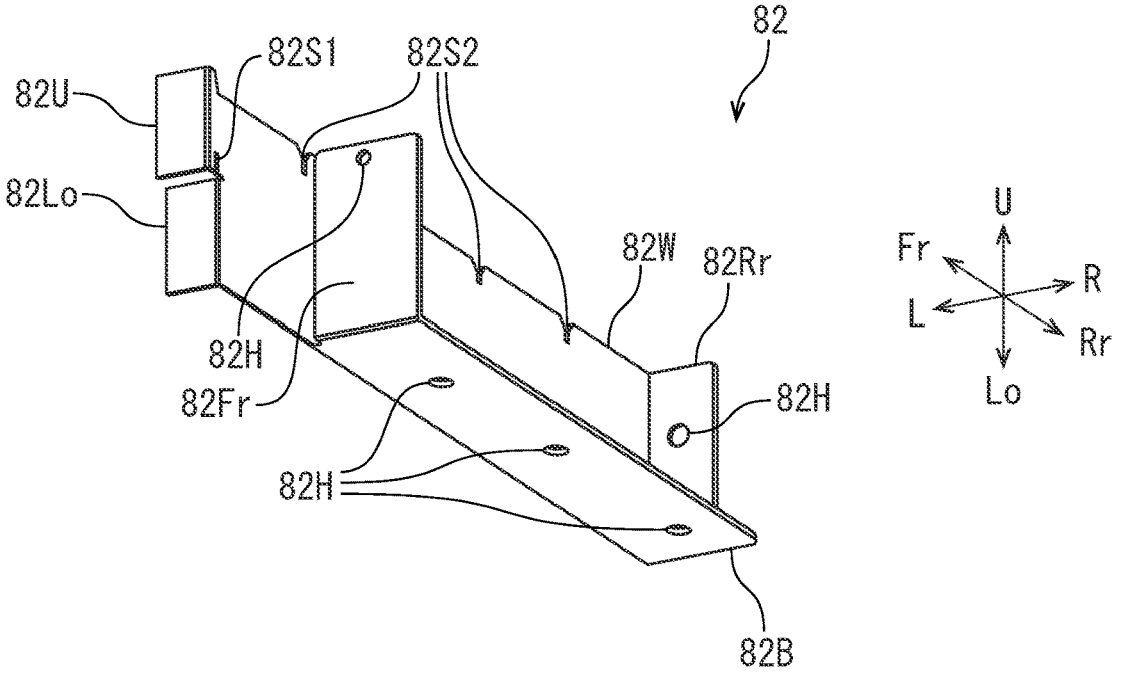
FIG. 10B is a perspective view showing the lower fixing member according to the embodiment of the present disclosure.

[Lower Fixing Member] The lower fixing member 82 (See FIG. 10A and FIG. 10B) is formed by sheet metal working of a plate material made of stainless steel. The lower fixing member 82 has a bottom plate part 82B, a wall part 82W extending upward from the left end portion of the bottom plate part 82B, a rear fixing part 82Rr extending rightward from the rear end portion of the wall part 82W, a front fixing part 82Fr extending upward from the front end portion of the bottom plate part 82B, a front wall upper part 82U extending leftward from the upper portion of the front end portion of the wall part 82W, and a front wall lower part 82Lo extending leftward from the lower portion of the front end portion of the wall part 82W. Because the front wall upper part 82U is disposed slightly forward of the front wall lower part 82Lo, a step is formed between the front wall upper part 82U and the front wall lower part 82Lo. A first notch 82S1 extending upward is formed in the wall part 82W between the front wall upper part 82U and the front wall lower part 82Lo. The bottom plate part 82B, the rear fixing part 82Rr, and the front fixing part 82Fr have screw holes 82H. The wall part 82W has a second notch 82S2 in the upper end portion at four positions at the same intervals as the interval between the notches 81S of the upper fixing member 81 in the front-and-rear direction.

Figure 11:
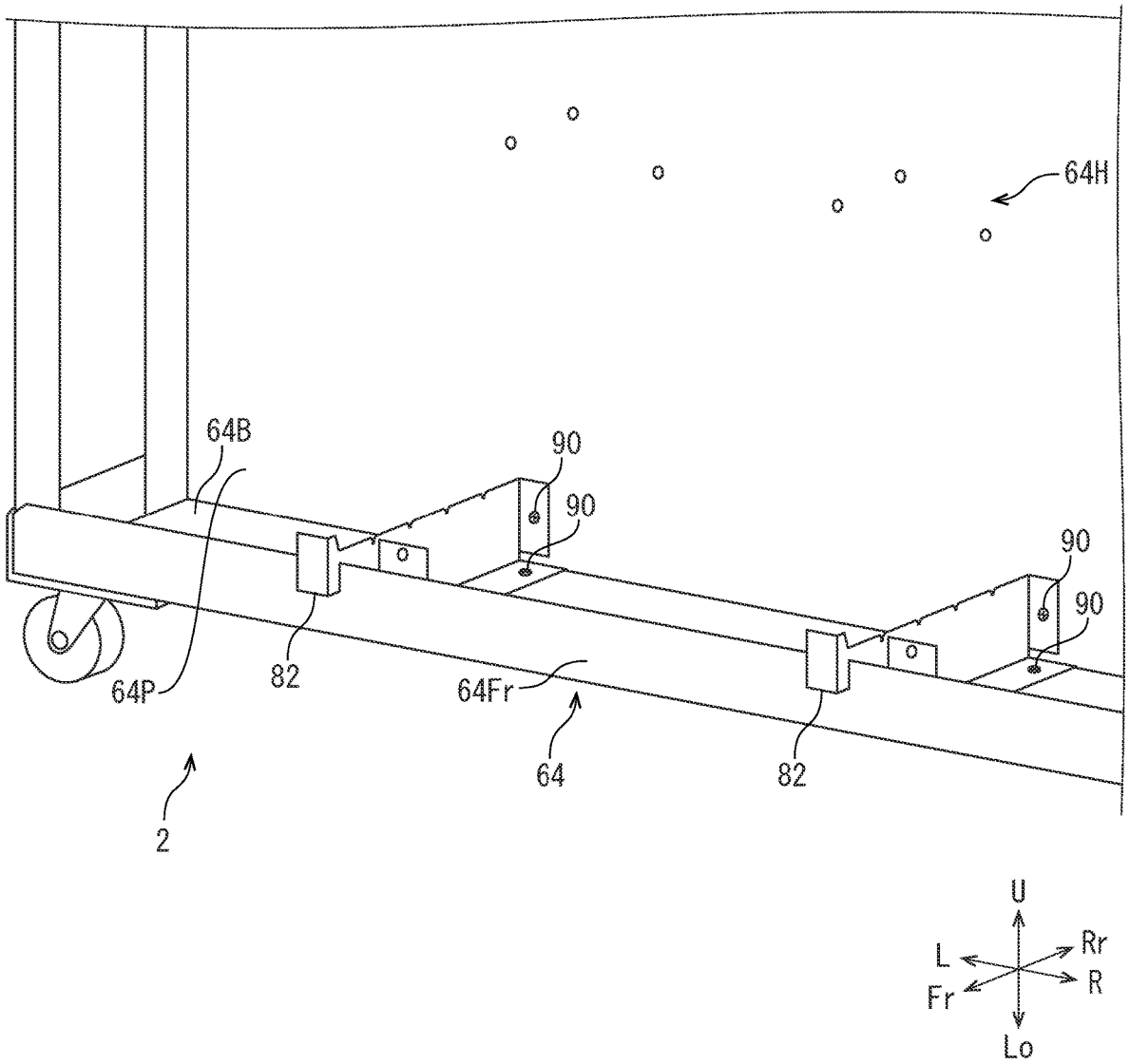
FIG. 11 is a perspective view showing a state where the lower fixing member is mounted to a frame according to the embodiment of the present disclosure.
Figure 12:
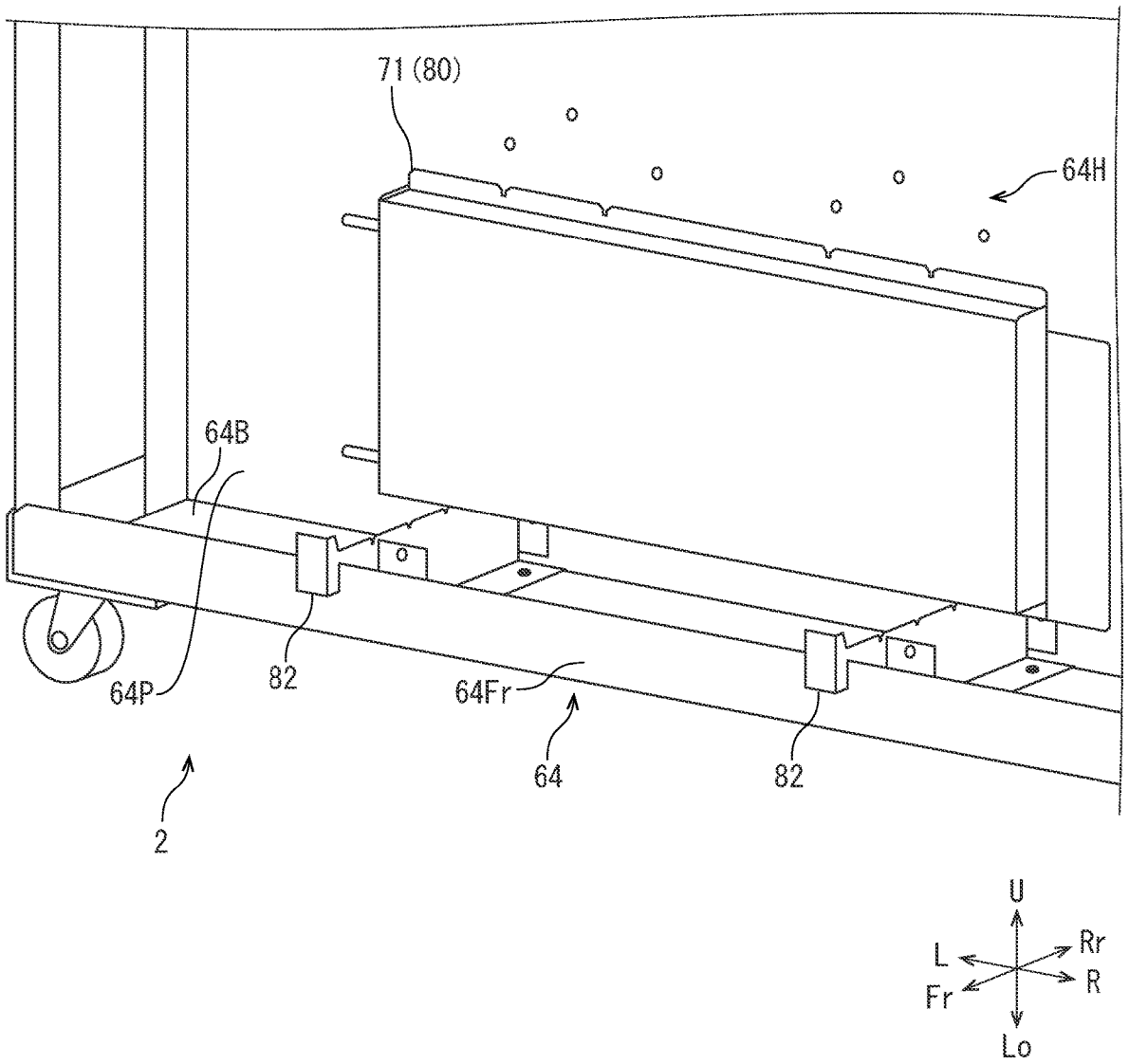
FIG. 12 is a perspective view showing a state where the innermost (the rearmost) heater unit is placed on the lower fixing member according to the embodiment of the present disclosure.
Figure 13:
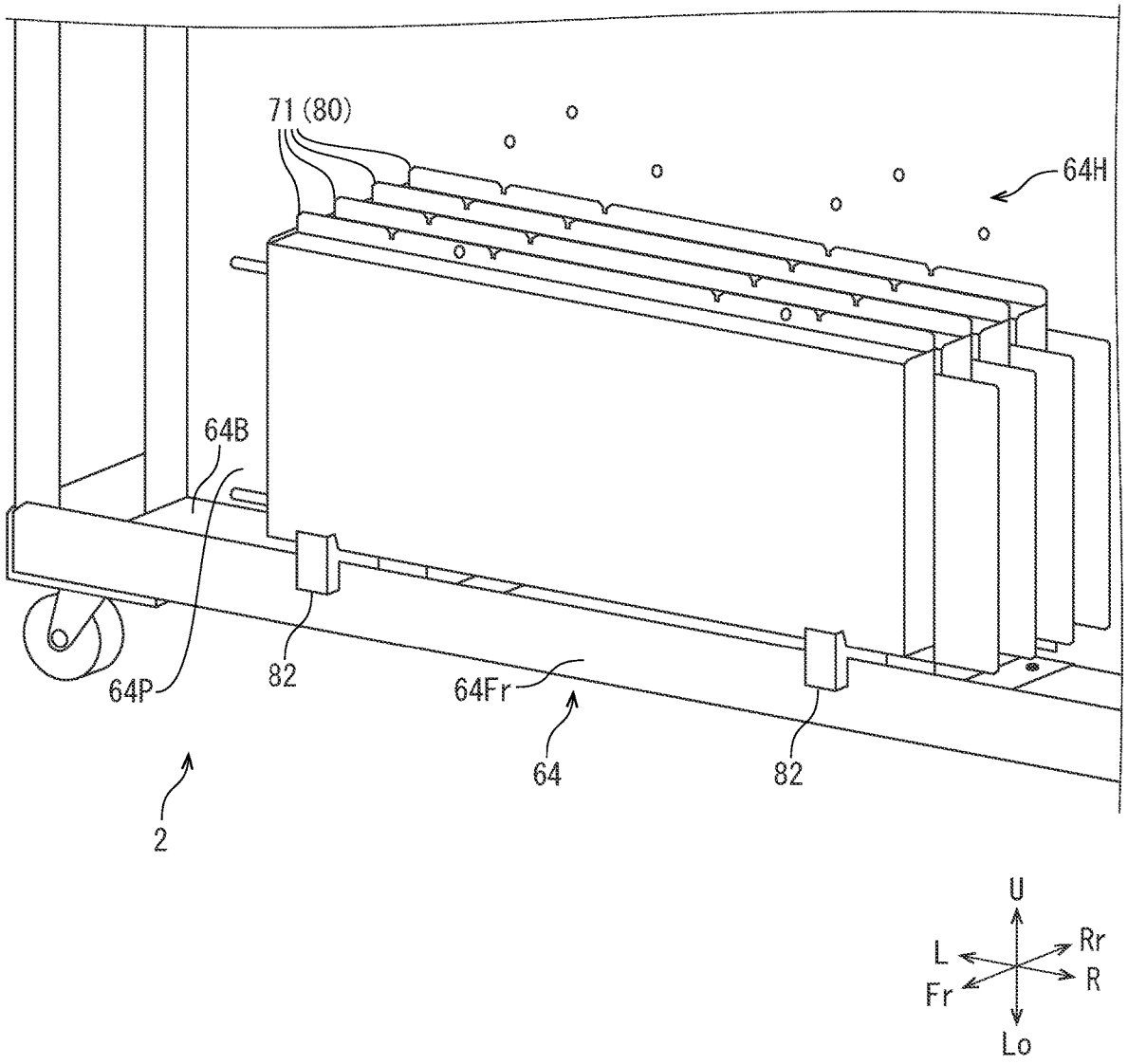
FIG. 13 is a perspective view showing a state where all the heater units are placed on the lower fixing member according to the embodiment of the present disclosure.
Figure 14:
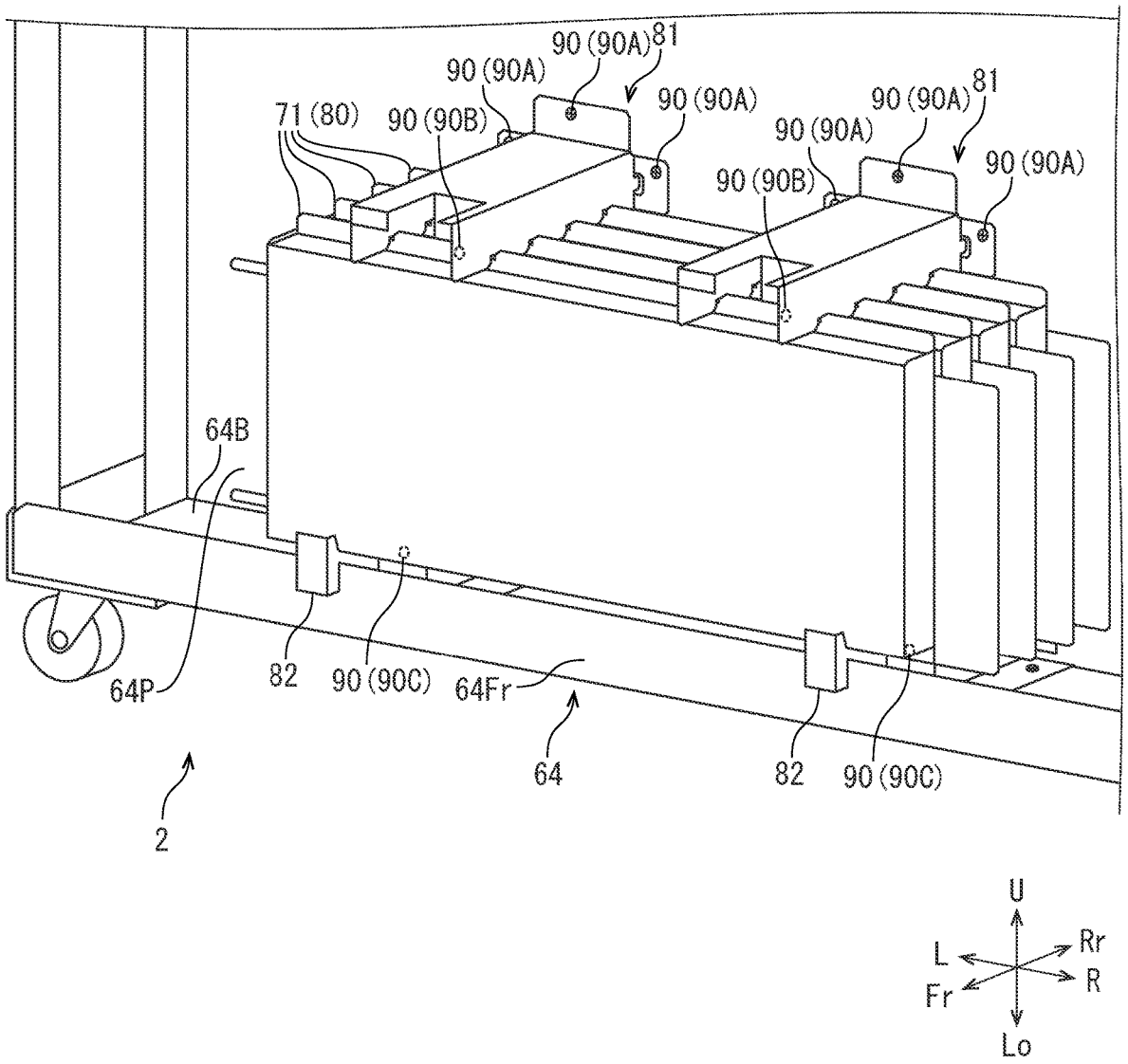
FIG. 14 is a perspective view showing a state where the heater unit is fixedly attached to the upper fixing member according to the embodiment of the present disclosure.
Figure 15:
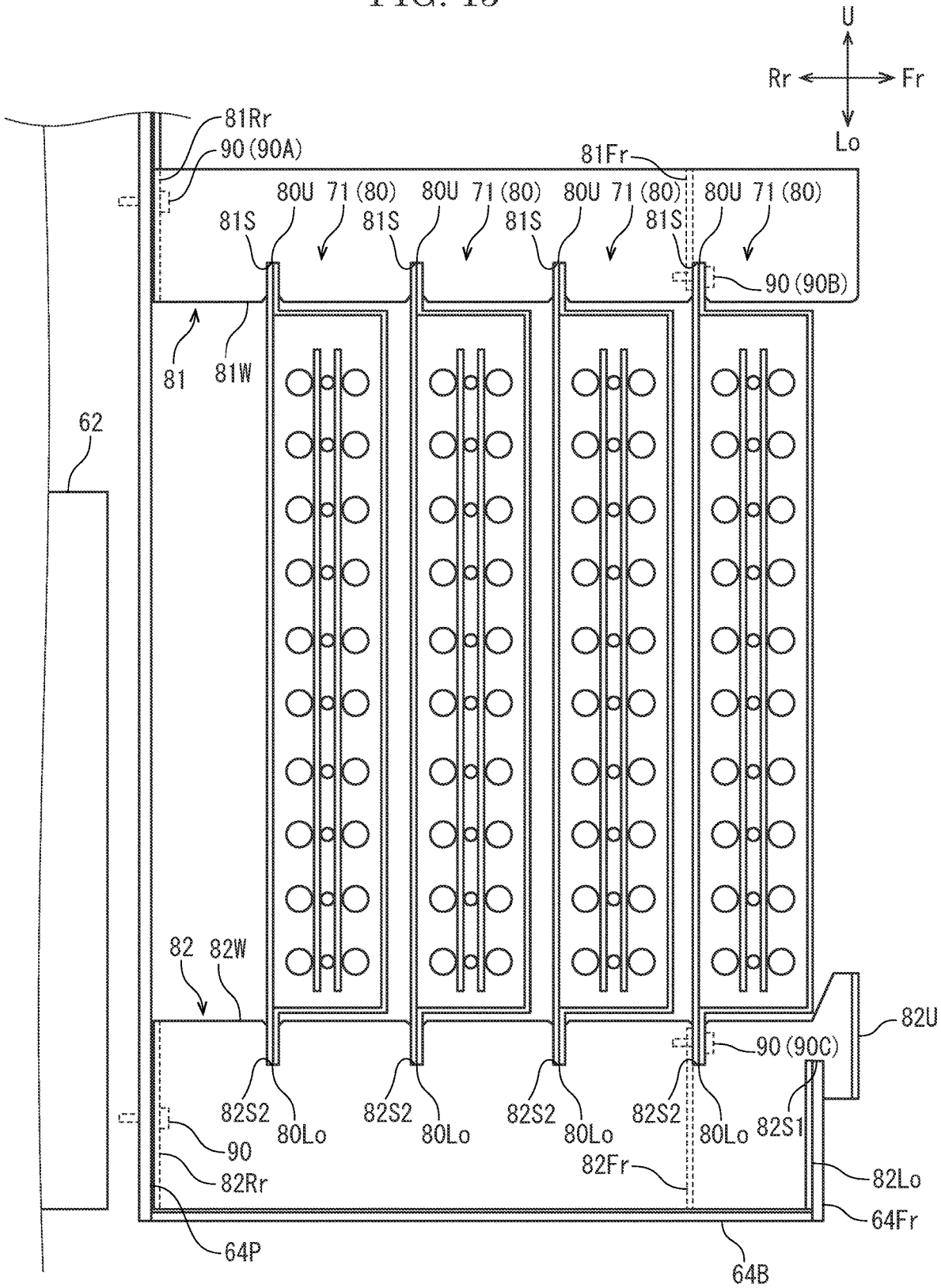
FIG. 15 is a sectional view schematically showing the heater unit and its periphery according to the embodiment of the present disclosure.

[Attachment of Heater Unit] Next, an attachment way of the heater units 71 will be described. FIG. 11 is a perspective view showing a state where the lower fixing member 82 is mounted to the frame 64. FIG. 12 is a perspective view showing a state where the innermost (the rearmost) heater unit 71 is placed on the lower fixing member 82. FIG. 13 is a perspective view showing a state where all the heater units 71 are placed on the lower fixing member 82. FIG. 14 is a perspective view showing a state where the heater units 71 are fixedly attached by the upper fixing member 81. FIG. 15 is a sectional view schematically showing the heater units 71 and their periphery.

First, as shown in FIG. 11, the two lower fixing members 82 are mounted to the frame 64. Specifically, the first notch 82S1 of the lower fixing member 82 is engaged with the front wall portion 64Fr of the frame 64, the bottom plate part 82B of the lower fixing member 82 is fixedly mounted to the bottom plate portion 64B of the frame 64 using screws 90 (an example of a removable fixture), and then the rear fixing part 82Rr of the lower fixing member 82 is fixedly mounted to the partition wall portion 64P of the frame 64 using screws 90.

Next, as shown in FIG. 12, the first heater unit 71 is placed on the innermost portion (the rearmost portion) of the lower fixing member 82. Specifically, the notch 80S of the lower flange part 80Lo of the first heater unit 71 is engaged with the innermost second notch 82S2 of the lower fixing member 82.

In the same manner, as shown in FIG. 13, the second to fourth heater units 71 are placed on the lower fixing member 82. Specifically, the notch 80S of the lower flange part 80Lo of the second heater unit 71 is engaged with the second notch 82S2 second from the rearmost. Next, the notch 80S of the lower flange part 80Lo of the third heater unit 71 is engaged with the second notch 82S2 third from the rearmost. Next, the notch 80S of the lower flange part 80Lo of the fourth heater unit 71 is engaged with the outermost (the foremost) second notch 82S2.

Next, as shown in FIG. 14, the upper fixing member 81 is mounted. Specifically, the notches 81S of the upper fixing member 81 are engaged with the notches 80S of the upper flange parts 80U of the four heater units 71. Next, the rear fixing part 81Rr of the upper fixing member 81 is fixedly mounted to the partition wall portion 64P using screws 90 (90A, a first fixture). Next, the lower flange part 80Lo of the fourth (the outermost) heater unit 71 is fixedly attached to the front fixing part 82Fr of the lower fixing member 82 using screws 90 (90C, a third fixture). Also, the upper flange part 80U of the fourth heater unit 71 is fixedly attached to the front fixing part 81Fr of the upper fixing member 81 using screws 90 (90B, a second fixture).

In the above manner, the four heater units 71 are arranged in the front-and-rear direction, and fixedly attached to the frame 64 by the upper fixing member 81 and the lower fixing member 82. The partition wall portion 64P, the upper fixing members 81, the lower fixing members 82 and the fourth heater unit 71 forms a closed box-shaped structure. As described above, the arrangement direction of the heater units 71 is the front-and-rear direction.

[Detachment of Heater Unit] Next, a detachment way of the heater units 71 will be described. In the embodiment, a case where the second heater unit 71 from the rearmost is failed and the other heater units 71 are not failed will be described.

Figure 16:
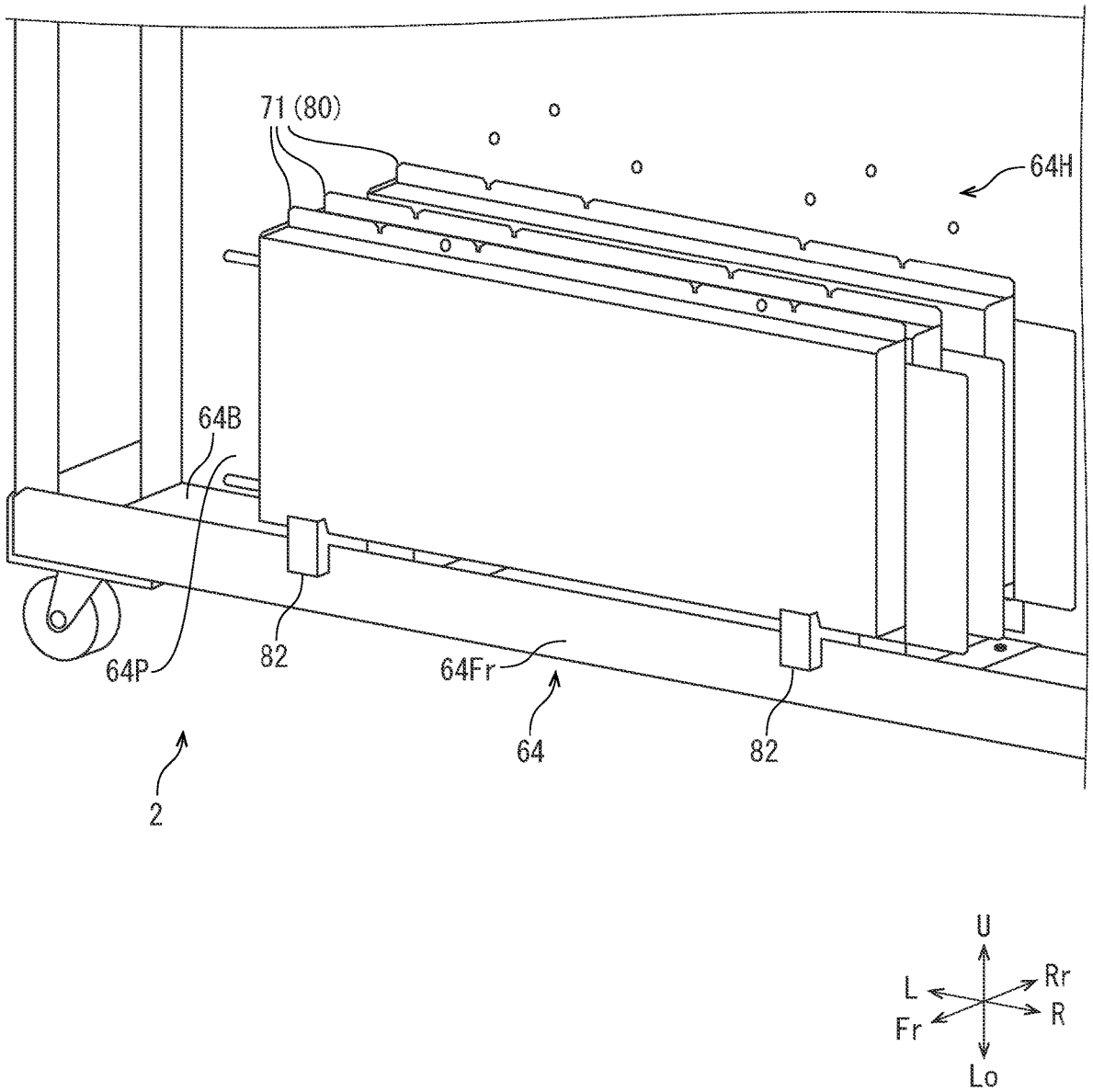
FIG. 16 is a perspective view showing a state where the innermost heater is detached according to the embodiment of the present disclosure.

First, the screws 90 (90A, 90B) are removed from the front fixing part 81Fr and the rear fixing part 81Rr of the upper fixing member 81, and then the upper fixing member 81 is removed from the four heater units 71 (see FIG. 13). Next, the second heater unit 71 from the rearmost is lifted to disengage the notch 80S of the lower flange part 80Lo from the second notch 82S2 of the lower fixing member 82, and then the heater unit 71 is drawn out leftward or rightward. In the above manner, the failed heater unit 71 is only detached from the frame 64. FIG. 16 is a perspective view showing a state where the second heater unit 71 from the rearmost is detached.

In a case where the rearmost heater unit 71 or the third heater unit 71 from the rearmost is failed, after the upper fixing member 81 is removed in the above manner, the failed heater unit 71 is lifted and drawn out leftward or rightward. Then, the failed heater unit 71 is only detached from the frame 64.

Figure 17:
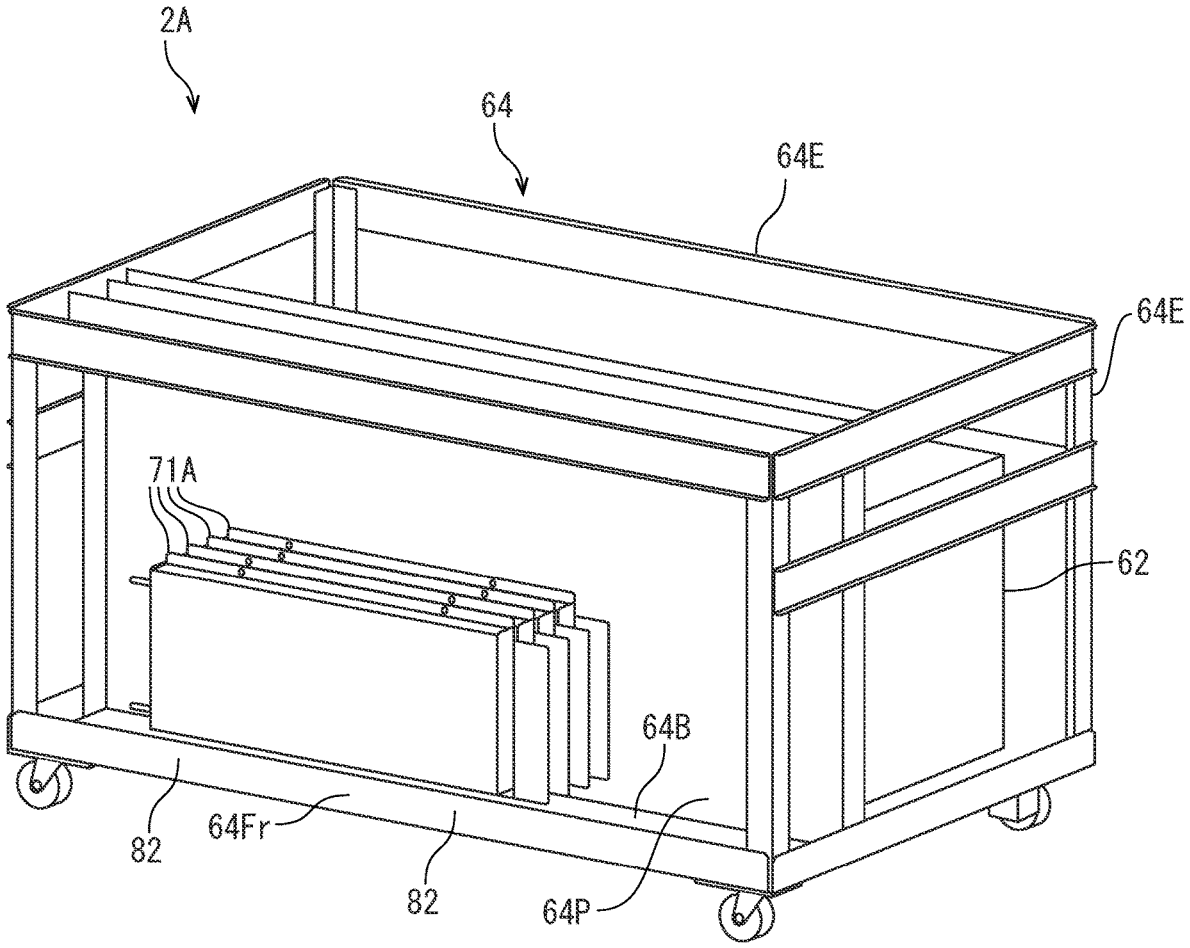
FIG. 17 PRIOR ART
FIG. 17 is a perspective view showing an inside of a conventional ink supply device.
Figure 17:
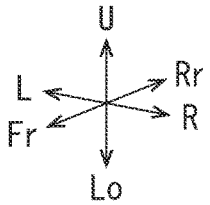
FIG. 17 PRIOR ART
Figure 18:
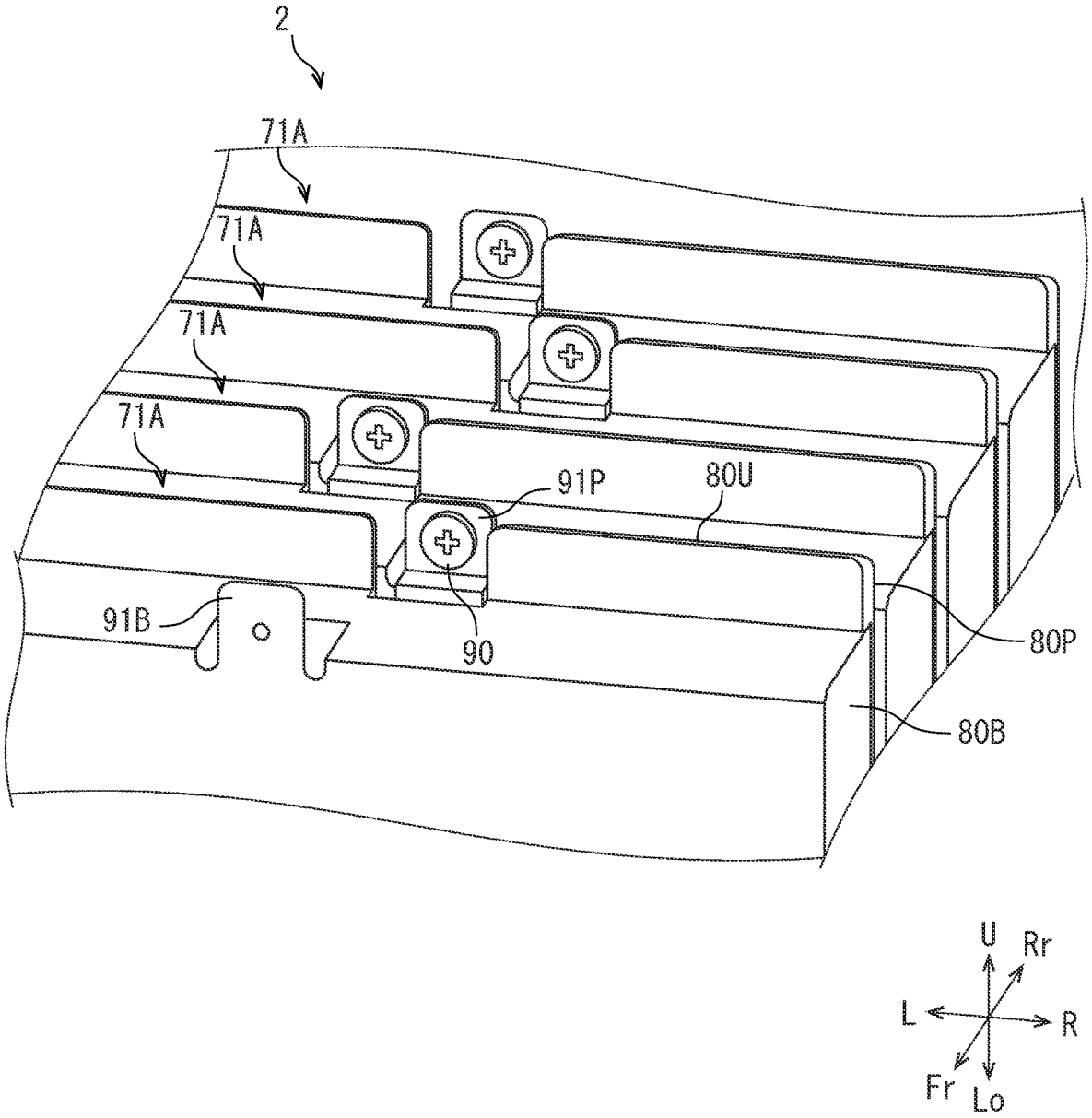
FIG. 18 PRIOR ART
FIG. 18 is an enlarged perspective view showing an upper flange part 80U of the conventional ink supply device.
Figure 19A:
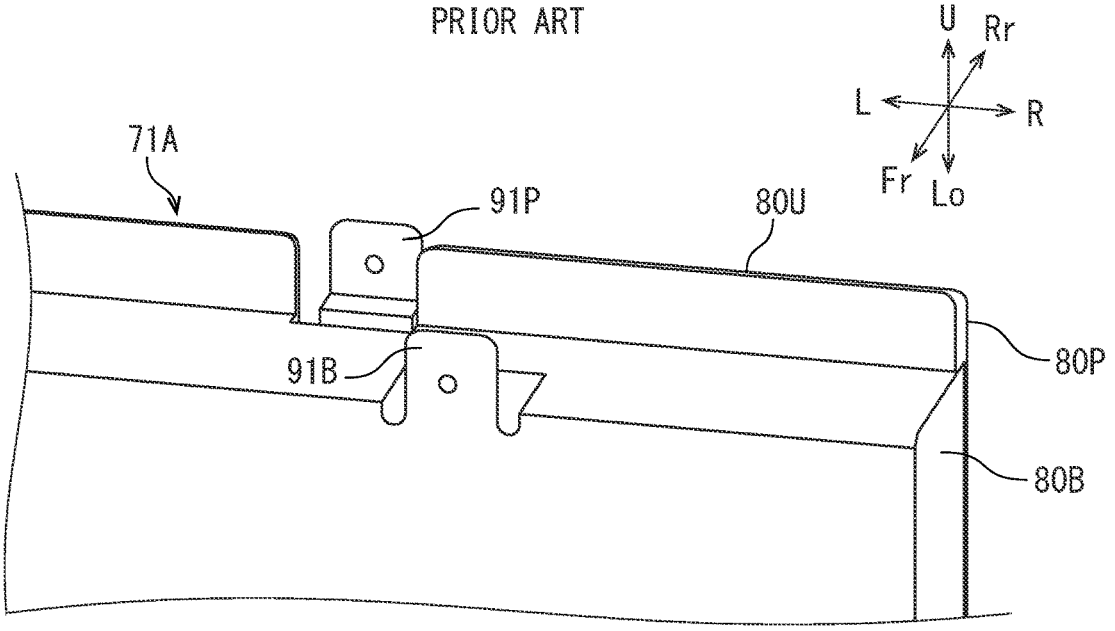
FIG. 19A PRIOR ART
FIG. 19A is a perspective view showing a conventional heater unit.
Figure 19B:
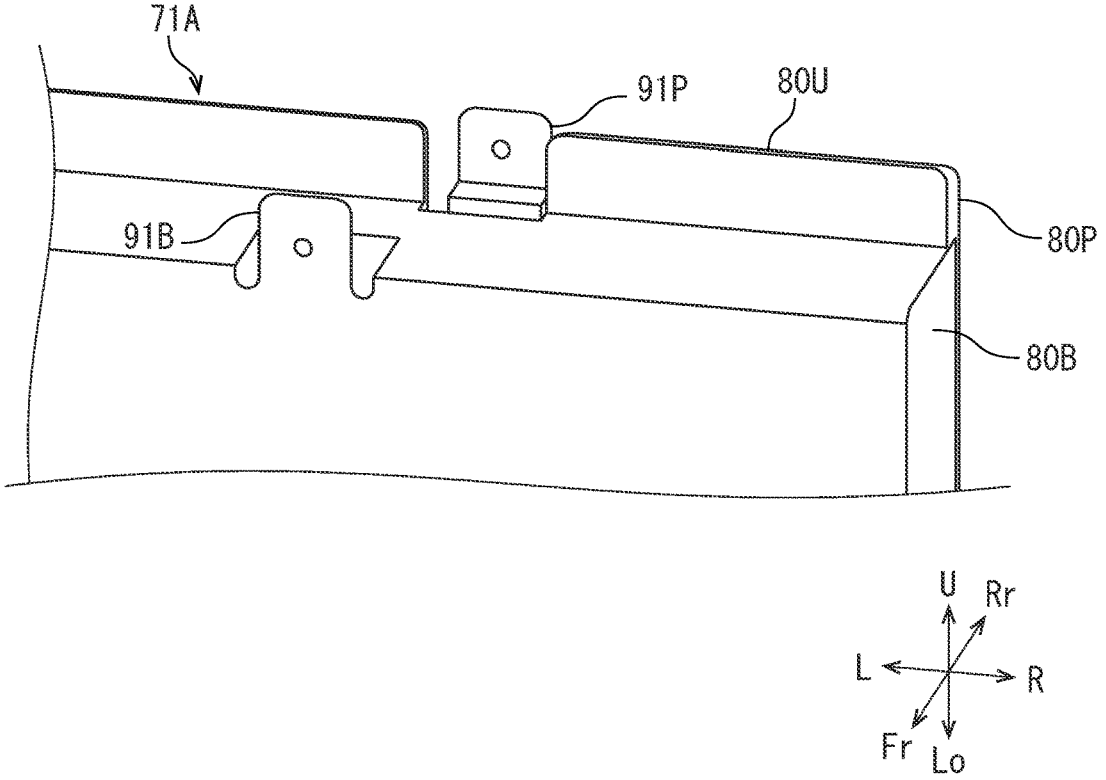
FIG. 19B PRIOR ART
FIG. 19B is a perspective view showing the conventional heater unit.

Here, for comparison, a conventional ink supply device 2A will be described. FIG. 17 is a perspective view showing an inside of the conventional ink supply device 2A. FIG. 18 is an enlarged perspective view showing an upper flange part 80U of the conventional ink supply device 2A. FIG. 19A and FIG. 19B are perspective views showing a conventional heater unit 71A.

The ink supply device 2A is not provided with the upper fixing member 81 and the lower fixing member 82, and the heater units 71A are directly attached to the frame 64. Specifically, as shown in FIG. 18, the innermost heater unit 71A of the four heater units 71A is fixedly attached to the partition wall portion 64P using the screws 90, and the adjacent heater units 71A are coupled to each other using the screws 90. Then, in order to detach the innermost heater unit 71A or the second or third heater unit 71A from the innermost, it is necessary to detach all the heater units 71A disposed on the front side of the heater unit 71A to be detached. Also, it is necessary to detach the relay tube 74 connected to the heater unit 71A, troubles such as ink leakage or contamination may increase.

Further, as shown in FIG. 19A and FIG. 19B, it is necessary to form cut and raised portions 91B, 91P for fastening the screws 90 in the box-shaped member 80B and the plate-shaped member 80P, respectively. Further, in order to secure a space for inserting a tool for fastening the screw 90, it is necessary to prepare at least two casings 80 in which the cut and raised portions 91B and 91P are shifted in the left-and-right direction. Further, since the heater unit 71A is fixedly attached only by the screws 90, there is a possibility that the screws 90 are shear-fractured when an external force in the upper-and-lower direction or the left-and-right direction is applied to the heater unit 71A. In the ink supply device 2 according to the present embodiment, these problems do not occur.

As described above, according to the ink supply device 2 of the present embodiment, in a case where the heater units 71 are arranged in the horizontal arrangement direction, it becomes possible to detach the failed heater unit 71 without detaching the heater units 71 which are not failed.

According to the ink supply device 2 according to the present embodiment, one end portion of the upper fixing member 81 in the arrangement direction of the heater units 71 is fixedly mounted to the frame 64 using the screws 90, and the farthest heater unit 71 from the end portion of the upper fixing member 81 to the frame 64 is fixedly attached to the lower fixing member 82 and the upper fixing member 81 using the screws 90. According to the configuration, because the partition wall portion 64P of the frame 64, the upper fixing member 81, the lower fixing member 82 and the heater unit 71 forms a closed box-shaped structure, it becomes possible to enhance rigidity of the device.

Further, according to the ink supply device 2 of the present embodiment, the upper fixing member 81 and the lower fixing member 82 have the notch 81S and the second notch 82S2 with which the heater unit 71 is engaged, the heater units 71 are easily positioned in the arrangement direction. Also, it becomes possible to prevent a displacement of the heater units 71 in the arrangement direction. Further, when the failed heater unit 71 is detached, it becomes possible to prevent a displacement of the remaining heater units 71 in the arrangement direction.

Further, according to the ink supply device 2 of the present embodiment, the heater unit 71 has the notches 80S with which the upper fixing member 81 and the lower fixing member 82 are engaged, the heater units 71 are easily positioned in a direction crossing to the arrangement direction. Also, it becomes possible to prevent a displacement of the heater units 71 in the direction crossing to the arrangement direction.

Further, according to the ink supply device 2 of the present embodiment, the upper fixing members 81 and the lower fixing members 82 are provided at a plurality of positions in the direction crossing to the arrangement direction of the heater units 71. According to the configuration, because the closed box-shaped structure is formed at the plurality of positions, it becomes possible to enhance the rigidity of the device.

The above embodiment may be modified as follows.

The above embodiment shows an example where the upper fixing member 81 and the lower fixing member 82 have different shapes, but the lower fixing member 82 may have a shape in which the upper fixing member 81 is inverted upside down. Alternatively, the upper fixing member 81 may have a shape in which the lower fixing member 82 is inverted upside down. According to this configuration, an increasing of the cost can be suppressed by using the upper fixing member 81 and the lower fixing member 82 in common.

The above embodiment shows an example where the notches 80S are provided in the upper flange part 80U and the lower flange part 80Lo of the heater unit 71, but these notches 80S may not be provided.

The above embodiment shows an example where the upper fixing member 81 and the lower fixing member 82 are provided at two positions in the direction crossing to the arrangement direction of the heater units 71, but the upper fixing member 81 and the lower fixing member 82 may be provided at one position. In this case, a spacer for supporting the lower flange part 80Lo of the heater unit 71 may be provided at a place where the lower fixing member 82 is not provided. According to this configuration, the increasing of the cost can be suppressed. Further, the upper fixing members 81 and the lower fixing member 82 may be provided at three or more positions. According to this configuration, it becomes possible to enhance the rigidity of the device. Note that the number of the upper fixing member 81 and the lower fixing member 82 need not be the same.

The above embodiment shows an example where the partition wall portion 64P of the frame 64, the upper fixing member 81, the lower fixing member 82, and the foremost heater unit 71 form a closed box-shaped structure. However, a reinforcing member such as a columnar shape or a plate shape may be provided on the further front side of the foremost heater unit 71, and a closed box-shaped structure may be formed of the partition wall portion 64P, the upper fixing member 81, the lower fixing member 82 and the reinforcing member. According to this constitution, the stress of the foremost heater unit 71 can be suppressed.

Although the present disclosure has been described with respect to specific embodiments, the present disclosure is not limited to the embodiments described above. Those skilled in the art will be able to modify the above embodiments without departing from the scope and spirit of the present disclosure.

The invention claimed is:

1. An ink supply device comprising:

a plurality of ink containers in which ink is stored;

a plurality of heater units arranged in a horizontal arrangement direction, the heater unit including a tube in which the ink fed from the ink container is passed, a heater heating the ink passing through the tube and a casing by which the tube and the heater are supported;

a frame in which the ink containers and the heater units are stored;

a lower fixing member fixedly mounted to the frame and holding all lower portions of the heater units; and an upper fixing member detachably mounted to the frame and holding all upper portions of the heater units.

2. The ink supply device according to claim 1, wherein one end portion of the upper fixing member in the arrangement direction is fixedly mounted to the frame using a removable first fixture, and the farthest heater unit from the one end portion of the upper fixing member is fixedly attached to the upper fixing member using a removable second fixture.

3. The ink supply device according to claim 2, wherein the farthest heater unit from the one end portion of the upper fixing member is fixedly attached to the lower fixing member using a removable third fixture.

4. The ink supply device according to claim 3, wherein the third fixture is a screw.

5. The ink supply device according to claim 2, wherein the first and the second fixtures are screws.

6. The ink supply device according to claim 1, wherein one end portion of the upper fixing member in the arrangement direction is fixedly mounted to the frame using a removable first fixture, and the farthest heater unit from the one end portion of the upper fixing member is fixedly attached to the lower fixing member using a removable third fixture.

7. The ink supply device according to claim 6, wherein the first and the third fixtures are screws.

8. The ink supply device according to claim 1, wherein the upper fixing member and the lower fixing member have notches with which the heater unit is engaged.

9. The ink supply device according to claim 8, wherein the upper fixing member and the lower fixing member each has a pair of wall parts, and the notches are provided in the wall parts.

10. The ink supply device according to claim 8, wherein the heater unit has notches with which the upper fixing member and the lower fixing member are engaged.

11. The ink supply device according to claim 10, wherein the notches are formed in the casing.

12. The ink supply device according to claim 1, wherein a partition wall portion of the frame to which the upper fixing member and the lower fixing member are fixedly mounted, the upper fixing member, the lower fixing member and the farthest heater unit from the partition wall portion form a closed box-shaped structure.

13. The ink supply device according to claim 1, wherein the upper fixing member and the lower fixing members are disposed at a plurality of positions in a direction crossing to the arrangement direction.

14. An image forming system comprising:

the ink supply device according to claim 1; and an inkjet recording apparatus including a conveyance unit conveying a sheet-like recording medium and an inkjet head ejecting the ink supplied through the tube on the recording medium conveyed by the conveyance unit.

* * * * *